US007116300B2

(12) United States Patent
Kageyama et al.

(10) Patent No.: US 7,116,300 B2
(45) Date of Patent: Oct. 3, 2006

(54) DRIVE CIRCUIT AND IMAGE DISPLAY APPARATUS

(75) Inventors: Hiroshi Kageyama, Kokubunji (JP); Yoshiro Mikami, Hitachiota (JP); Hajime Akimoto, Ome (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/938,614

(22) Filed: Aug. 27, 2001

(65) Prior Publication Data

US 2002/0180679 A1 Dec. 5, 2002

(30) Foreign Application Priority Data

Feb. 23, 2001 (JP) ..... 2001-048472

(51) Int. Cl.
*G09G 3/36* (2006.01)

(52) U.S. Cl. ..... 345/89; 345/87; 345/96; 345/98; 345/204

(58) Field of Classification Search ..... 345/89, 345/92, 90, 76, 98, 100, 87, 96, 204–206
See application file for complete search history.

(56) References Cited

U.S. PATENT DOCUMENTS 4,450,433 A * 5/1984 Moriyama ..... 341/145
5,212,484 A * 5/1993 Hillis ..... 341/154
5,454,013 A * 9/1995 Minami et al. ..... 375/297
5,608,421 A * 3/1997 Okada ..... 345/100
5,689,259 A * 11/1997 Ozguc ..... 341/144
5,870,045 A * 2/1999 Hamanishi et al. ..... 341/136
5,952,948 A * 9/1999 Proebsting ..... 341/144
6,160,437 A * 12/2000 Kim et al. ..... 327/408
6,191,779 B1 * 2/2001 Taguchi et al. ..... 345/204
6,201,523 B1 * 3/2001 Akiyama et al. ..... 345/96
6,326,913 B1 * 12/2001 Chao et al. ..... 341/144
6,335,721 B1 * 1/2002 Jeong ..... 345/100
6,411,273 B1 * 6/2002 Nakamura et al. ..... 345/98
6,459,395 B1 * 10/2002 Kida et al. ..... 341/126

FOREIGN PATENT DOCUMENTS

JP 2000-227585 8/2000

* cited by examiner

*Primary Examiner*—Richard Hjerpe
*Assistant Examiner*—Leonid Shapiro
(74) *Attorney, Agent, or Firm*—Dickstein Shapiro LLP

(57) ABSTRACT

Specified thin-film transistors 26 and 27 are caused to conduct by a gradation signal inputted in control circuits 24 and 25, and resistors with a conduction resistance of activated transistors are inserted between any of reference voltages V0, V2, and V4 and an output terminal T1 or between any of reference voltages V1 and V3 and an output terminal T2, and a pair of thin-film transistors 29 in a sampling circuit 23 are caused to conduct simultaneously in sync with the gradation signal. If a signal line SL1 is selected, reference voltages V0, V2, or V4 and V1 or V3 are applied to the signal line SL1, either as they are or as divided by the conduction resistance of the activated thin-film transistors, by using a junction point between the sampling circuit 23 and signal line SL1 as a voltage dividing point.

34 Claims, 14 Drawing Sheets

21, 22 D/A CONVERSION CIRCUIT
23 SAMPLING CIRCUIT
24, 25, 28 CONTROL CIRCUIT
26, 27, 29 THIN-FILM TRANSISTOR
SL1 TO SL4 SIGNAL LINE 21, 22 D/A CONVERSION CIRCUIT
23 SAMPLING CIRCUIT
24, 25, 28 CONTROL CIRCUIT
26, 27, 29 THIN-FILM TRANSISTOR
SL1 TO SL4 SIGNAL LINE

FIG. 3A

| IN | A | B | C | D | E | F | G | H | I |
|---|---|---|---|---|---|---|---|---|---|
| 0 | 1 | 1 | 1 | 0 | 0 | 0 | 0 | 0 | 0 |
| 1 | 0 | 0 | 1 | 0 | 0 | 0 | 0 | 0 | 0 |
| 2 | 0 | 1 | 0 | 0 | 0 | 0 | 0 | 0 | 0 |
| 3 | 1 | 0 | 0 | 0 | 0 | 0 | 0 | 0 | 0 |
| 4 | 0 | 0 | 0 | 0 | 0 | 0 | 0 | 0 | 0 |
| 5 | 0 | 0 | 0 | 1 | 1 | 0 | 0 | 0 | 0 |
| 6 | 0 | 0 | 0 | 0 | 0 | 0 | 0 | 0 | 0 |
| 7 | 0 | 0 | 0 | 0 | 0 | 1 | 0 | 0 | 0 |
| 8 | 0 | 0 | 0 | 1 | 1 | 1 | 0 | 0 | 0 |
| 9 | 0 | 0 | 0 | 0 | 0 | 1 | 0 | 0 | 0 |
| 10 | 0 | 0 | 0 | 0 | 0 | 0 | 0 | 0 | 0 |
| 11 | 0 | 0 | 0 | 1 | 1 | 0 | 0 | 0 | 0 |
| 12 | 0 | 0 | 0 | 0 | 0 | 0 | 0 | 0 | 0 |
| 13 | 0 | 0 | 0 | 0 | 0 | 0 | 1 | 0 | 0 |
| 14 | 0 | 0 | 0 | 0 | 0 | 0 | 0 | 1 | 0 |
| 15 | 0 | 0 | 0 | 0 | 0 | 0 | 0 | 0 | 1 |

FIG. 3B

| IN | J | K | L | M | N | O |
|---|---|---|---|---|---|---|
| 0 | 0 | 0 | 0 | 0 | 0 | 0 |
| 1 | 1 | 0 | 0 | 0 | 0 | 0 |
| 2 | 0 | 1 | 0 | 0 | 0 | 0 |
| 3 | 0 | 0 | 1 | 0 | 0 | 0 |
| 4 | 1 | 1 | 1 | 0 | 0 | 0 |
| 5 | 0 | 0 | 1 | 0 | 0 | 0 |
| 6 | 0 | 1 | 0 | 0 | 0 | 0 |
| 7 | 1 | 0 | 0 | 0 | 0 | 0 |
| 8 | 0 | 0 | 0 | 0 | 0 | 0 |
| 9 | 0 | 0 | 0 | 1 | 0 | 0 |
| 10 | 0 | 0 | 0 | 0 | 1 | 0 |
| 11 | 0 | 0 | 0 | 0 | 0 | 1 |
| 12 | 0 | 0 | 0 | 1 | 1 | 1 |
| 13 | 0 | 0 | 0 | 0 | 0 | 1 |
| 14 | 0 | 0 | 0 | 0 | 1 | 0 |
| 15 | 0 | 0 | 0 | 1 | 0 | 0 |

FIG. 4

| IN | GENERATION OF VSL |
|---|---|
| 0 | Vn<br>R1//R2//R3<br>RSW |
| 1 | Vn Vn+1<br>R1 R3<br>RSW RSW<br>VSL=<br>(3Vn+Vn+1)/4 |
| 2 | Vn Vn+1<br>R2 R2<br>RSW RSW<br>VSL=<br>(Vn+Vn+1)/2 |
| 3 | Vn Vn+1<br>R3 R1<br>RSW RSW<br>VSL=<br>(Vn+3Vn+1)/4 |

| D[3:0] | $V_{SL}$ |
|---|---|
| 0 | $V_0$ |
| 1 | $(3V_0+V_1)/4$ |
| 2 | $(V_0+V_1)/2$ |
| 3 | $(V_0+3V_1)/4$ |
| 4 | $V_1$ |
| 5 | $(3V_1+V_2)/4$ |
| 6 | $(V_1+V_2)/2$ |
| 7 | $(V_1+3V_2)/4$ |
| 8 | $V_2$ |
| 9 | $(3V_2+V_3)/4$ |
| 10 | $(V_2+V_3)/2$ |
| 11 | $(V_2+3V_3)/4$ |
| 12 | $V_3$ |
| 13 | $(3V_3+V_4)/4$ |
| 14 | $(V_3+V_4)/2$ |
| 15 | $(V_3+3V_4)/4$ |

| IN | A | B | C | D |
|---|---|---|---|---|
| 0 | 1 | 0 | 0 | 0 |
| 1 | 0 | 1 | 0 | 0 |
| 2 | 0 | 0 | 1 | 0 |
| 3 | 0 | 0 | 0 | 1 |

| IN | a | b | c |
|---|---|---|---|
| 0 | 1 | 1 | 1 |
| 1 | 0 | 0 | 1 |
| 2 | 0 | 1 | 0 |
| 3 | 1 | 0 | 0 |

| IN | d | e | f |
|---|---|---|---|
| 0 | 0 | 0 | 0 |
| 1 | 1 | 0 | 0 |
| 2 | 0 | 1 | 0 |
| 3 | 0 | 0 | 1 |

FIG. 9

| IN | GENERATION OF VSL |
|---|---|
| 0 | Vn<br>RDA<br>R1//R2//R3<br>RSW<br>VSL=Vn |
| 1 | Vn Vn+1<br>RDA RDA<br>R1 R3<br>RSW RSW<br>VSL=<br>(3Vn+Vn+1)/4 |
| 2 | Vn Vn+1<br>RDA RDA<br>R2 R2<br>RSW RSW<br>VSL=<br>(Vn+Vn+1)/2 |
| 3 | Vn Vn+1<br>RDA RDA<br>R3 R1<br>RSW RSW<br>VSL=<br>(Vn+3Vn+1)/4 |

| IN | 61 Aout | 62 Aout |
|---|---|---|
| 0 | V0 | V1 |
| 1 | V1 | V2 |
| 2 | V2 | V3 |
| 3 | V3 | V4 |

FIG. 15

| D[3:0] | (a) | (b) |
|---|---|---|
| 0 | $V_{H0}$ | $V_{L0}$ |
| 1 | $(3V_{H0}+V_{H1})/4$ | $(3V_{L0}+V_{L1})/4$ |
| 2 | $(V_{H0}+V_{H1})/2$ | $(V_{L0}+V_{L1})/2$ |
| 3 | $(V_{H0}+3V_{H1})/4$ | $(V_{L0}+3V_{L1})/4$ |
| 4 | $V_{H1}$ | $V_{L1}$ |
| 5 | $(3V_{H1}+V_{H2})/4$ | $(3V_{L1}+V_{L2})/4$ |
| 6 | $(V_{H1}+V_{H2})/2$ | $(V_{L1}+V_{L2})/2$ |
| 7 | $(V_{H1}+3V_{H2})/4$ | $(V_{L1}+3V_{L2})/4$ |
| 8 | $V_{H2}$ | $V_{L2}$ |
| 9 | $(3V_{H2}+V_{H3})/4$ | $(3V_{L2}+V_{L3})/4$ |
| 10 | $(V_{H2}+V_{H3})/2$ | $(V_{L2}+V_{L3})/2$ |
| 11 | $(V_{H2}+3V_{H3})/4$ | $(V_{L2}+3V_{L3})/4$ |
| 12 | $V_{H3}$ | $V_{L3}$ |
| 13 | $(3V_{H3}+V_{H4})/4$ | $(3V_{L3}+V_{L4})/4$ |
| 14 | $(V_{H3}+V_{H4})/2$ | $(V_{L3}+V_{L4})/2$ |
| 15 | $(V_{H3}+3V_{H4})/4$ | $(V_{L3}+3V_{L4})/4$ |

FIG. 18

| IN | 171About | 172About | 173About | 174About |
|---|---|---|---|---|
| 0 | VL0 | VL1 | VH0 | VH1 |
| 1 | VL1 | VL2 | VH1 | VH2 |
| 2 | VL2 | VL3 | VH2 | VH3 |
| 3 | VL3 | VL4 | VH3 | VH4 |

DRIVE CIRCUIT AND IMAGE DISPLAY APPARATUS

BACKGROUND OF THE INVENTION

1. Field of the Invention

The present invention relates to a drive circuit and an image display apparatus employing this drive circuit. More particularly, it relates to a drive circuit which outputs image signals in accordance with gradations to signal lines laid in an image display section and a display apparatus which employs the drive circuit.

2. Description of the Related Art

Conventionally, known image display apparatuses include, for example, active-matrix liquid crystal displays. The active-matrix liquid crystal display has a plurality of signal lines for transmitting image signals and a plurality of scanning lines for transmitting scanning signals formed in a matrix-like fashion in an image display area of a substrate, wherein liquid crystals and a thin-film transistor are placed near each intersection of the signal lines and scanning lines; the signal lines are connected to a drive circuit; the scanning lines are connected to a scanning circuit; the gate, drain, and source of each thin-film transistor are connected to a scanning line, signal line, and display electrode, respectively; a counter electrode acting as a transparent electrode is disposed in opposing relation to the display electrode; the liquid crystals are sandwiched between the display electrode and counter electrode; and holding capacitance and liquid-crystal capacitance are connected in parallel to the source electrode. During the process in which an analog voltage corresponding to a gradation signal is applied as an image signal to each signal line, a scanning pulse is applied to each scanning line once per frame time. A pixel signal corresponding to one line of pixels to which scanning pulses are applies is applied to each signal line, the thin-film transistors connected to the scanning line to which scanning pulses are applied are turned on, the image signal from each signal line is applied to the liquid crystals through between the drain and source of each thin-film transistor, and the liquid crystal is charged with pixel capacitance, which is the sum of the holding capacitance and liquid-crystal capacitance. Through repetition of these operations, voltages corresponding to the image signals are applied to the pixel capacitance of the entire panel surface repeatedly every frame time (for example, every 1/60 second) to display images in the image display area of the substrate.

The drive circuits mounted in this type of liquid crystal display include the one described in JP-A-2000-227585, specification. This drive circuit is configured to connect a high-tension side reference voltage VH and a low-tension side reference voltage LV via a plurality of resistor strings, divide the two reference voltages by a plurality of resistor strings, supply the divided voltages and the reference voltages to a D/A conversion circuit, output, from the D/A conversion circuit, analog voltages for the number of gradations necessary for display according to digital gradation signals, and supply each of the analog voltages in sequence to each signal line via a sampling circuit.

In the case of a drive circuit mounted in a multi-gradation image display apparatus, in particular, fewer reference voltages than the number of display gradations are input from outside the substrate equipped with the drive circuit and analog voltages are generated according to the number of gradations by the drive circuit on the substrate. This approach is used for the following reasons: the number of gradations increases exponentially with increases in the bit count of display gradation, but supplying the same number of reference voltages outside the substrate is disadvantageous in terms of the manufacturing cost and manufacturing technology of the image display apparatus because the substrate must be wired corresponding to the number of reference voltages which are to be input.

If voltages divided by resistor strings are generated by the drive circuit to output image signals from the drive circuit to each signal line according to gradations, a through current flows between high reference voltage VH and low reference voltage VL. Since the through current adds to the power consumption of the image display apparatus, it gets in the way of reducing power consumption, especially if a drive circuit is mounted in a battery powered image display apparatus of which low power consumption is required.

To reduce the through current, the resistance value of the resistor strings between the high reference voltage VH and low reference voltage VL must be maximized. On the other hand, with increases in the resistance between the reference voltages and signal line (drain wire), i.e., the output resistance of the drive circuit, the time required to charge the capacitance of the drain wire (wire connected to the drain of the thin-film transistor) becomes longer compared to the output resistance. Therefore, the output resistance of the drive circuit cannot be increased in the case of image display apparatus which feature high-resolution display or a high screen-refresh rate because of short sampling times. Thus, for the drive circuit, the resistance (resistance value) between the reference voltages should be decreased instead of increasing the resistance between the reference voltages and drain wire. As is the case with the prior art, let r1 and r2 denote the resistance values of two resistor strings and let r3 denote the combined resistance (sum of series resistance) of the D/A conversion circuit and sampling circuit, then the relationship among the reference voltage VH, reference voltage VL, and signal line in terms of resistance is represented by a T resistor circuit, in which one end of the resistance r1 is connected to the reference voltage VH, one end of the resistance r2 is connected to the reference voltage VL, and the signal line is connected to the series junction point between the resistance r1 and resistance r2 via the resistance r3. It can be seen that to maximize the resistance between the reference voltages VH and VL without increasing the resistance r0 between the reference voltages and signal line (r1+r3 or r2+r3), r3 can be set to zero (r3=0). To reduce r3, it is necessary to reduce the resistance value in the elements of the D/A conversion circuit and sampling circuit.

However, the D/A conversion circuit and sampling circuit consist of thin-film transistors and to reduce the resistance of the thin-film transistors, it is necessary to increase the mobility or size of the transistors or increase the supply voltage of the drive circuit. Increasing the size of the thin-film transistors or the supply voltage of the drive circuit also increases the current required to operate the thin-film transistors, resulting in increased power consumption of the drive circuit.

SUMMARY OF THE INVENTION

The object of the present invention is to provide a drive circuit which can increase a resistance between reference voltages without increasing the resistance between the reference voltages and signal lines as well as to provide a display apparatus which employs the drive circuit.

To attain the above object, the present invention provides a drive circuit comprising a plurality of digital-to-analog conversion circuits each of which selects one of different reference voltages according to a digital gradation signal and inserts resistors with resistance values corresponding to the above described gradation signal into a plurality of circuits connecting the selected reference voltages with a first output terminal or second output terminal; and a sampling circuit which connects the above described first output terminal to a plurality of signal lines one by one in response to a signal line selection signal synchronized with the above described gradation signal and connects the above described second output terminal to the above described plurality of signal lines one by one in response to the above described signal line selection signal, wherein when the above described sampling circuit selects signal lines, the reference voltage selected by one of the above described digital-to-analog conversion circuits and/or the reference voltage selected by the other of the above described digital-to-analog conversion circuits are output to the above described signal lines via the resistor inserted into any of the above described circuits.

Instead of the above described digital-to-analog conversion circuits, the above described drive circuit may use a plurality of digital-to-analog conversion circuits each of which selects one of different reference voltages according to a digital gradation signal, and a plurality of variable resistor circuits which insert resistors with resistance values corresponding to the above described gradation signal into a plurality of circuits connecting the selected reference voltages with a first output terminal or second output terminal.

At the time of using switching elements as main components, the drive circuit may comprise a plurality of digital-to-analog conversion circuits each of which consists of a plurality of circuits containing a plurality of switching elements with conduction resistances different from one another and connecting different reference voltages with a first output terminal or second output terminal and in which specified switching elements conduct according to a digital gradation signal; and a sampling circuit which has a first group of sampling switching elements inserted between the above described first output terminal and a plurality of signal lines and a second group of sampling switching elements inserted between the above described second output terminal and the above described plurality of signal lines, wherein the above described first group of sampling switching elements and the above described second group of sampling switching elements start to conduct one by one in response to a signal line selection signal synchronized with the above described gradation signal, and consequently, the reference voltages connected to specified switching elements belonging to one of the above described digital-to-analog conversion circuits and/or the reference voltages connected to specified switching elements belonging to the other of the above described digital-to-analog conversion circuits are output to the above described signal lines via specified conducting switching elements.

When mounting a plurality of digital-to-analog conversion circuits outside a drive circuit, the drive circuit may comprise a plurality of variable resistor circuits which insert resistors with resistance values corresponding to a digital gradation signal into a plurality of circuits connecting one of the plurality of digital-to-analog conversion circuits with a first output terminal and into a plurality of circuits connecting the other of the plurality of digital-to-analog conversion circuits with a second output terminal, the above described plurality of digital-to-analog conversion circuits outputting an analog voltage by converting it into different reference voltages according to the above described digital gradation signal; and a sampling circuit which has a first group of sampling switching elements inserted between the above described first output terminal and a plurality of signal lines and a second group of sampling switching elements inserted between the above described second output terminal and the above described plurality of signal lines, wherein the above described first group of sampling switching elements and the above described second group of sampling switching elements start to conduct one by one in response to a signal line selection signal synchronized with the above described gradation signal and select the signal lines, and as a result of the signal line selection by the above described sampling circuit, the reference voltages outputted from one of the above described digital-to-analog conversion circuits and/or the reference voltages outputted from the other of the above described digital-to-analog conversion circuits are output to the above described signal lines via the resistor inserted into any of the above described circuits.

In the above described drive circuit which uses a plurality of variable resistor circuits, the resistors with resistance values corresponding to the gradation signal may be constituted of switching elements which conduct according to the gradation signal or they may consist of such switching elements connected in series with resistance elements.

To output AC image signals to signal lines, the drive circuit can be equipped with a plurality of positive reference voltages (high-tension side) and a plurality of negative reference voltages (low-tension side); a first positive output terminal, a second positive output terminal, a first negative output terminal, and a second negative output terminal; and a plurality of positive digital-to-analog conversion circuits and a plurality of negative digital-to-analog conversion circuits in place of the plurality of digital-to-analog conversion circuits.

Specifically, the drive circuit may comprise a plurality of positive digital-to-analog conversion circuits each of which selects one of different positive reference voltages according to a digital gradation signal and inserts resistors with resistance values corresponding to the above described gradation signal into a plurality of circuits connecting the selected positive reference voltage with a first positive output terminal or second positive output terminal; and a plurality of negative digital-to-analog conversion circuits each of which selects one of different negative reference voltages according to a digital gradation signal and inserts resistors with resistance values corresponding to the above described gradation signal into a plurality of circuits connecting the selected negative reference voltage with a first negative output terminal or second negative output terminal.

Regarding a sampling circuit, each of the above described sampling circuits may be replaced by a positive sampling circuit which responds to a positive signal line selection signal synchronized with the gradation signal and a negative sampling circuit which responds to a negative signal line selection signal synchronized with the gradation signal.

For example, the drive circuit may comprise a positive sampling circuit which connects the above described first positive output terminal to a plurality of signal lines one by one in response to a positive signal line selection signal synchronized with the above described gradation signal and the above described second positive output terminal to the above described plurality of signal lines one by one in response to the above described positive signal line selection signal synchronized with the above described gradation signal; and a negative sampling circuit which connects the above described first negative output terminal to a plurality of signal lines one by one in response to a negative signal line selection signal synchronized with the above described gradation signal and the above described second negative output terminal to the above described plurality of signal lines one by one in response to the above described negative signal line selection signal synchronized with the above described gradation signal.

Furthermore, the drive circuit may comprise a plurality of positive variable resistor circuits and a plurality of negative variable resistor circuits, in place of the above described plurality of variable resistor circuits.

For example, the drive circuit may comprise a plurality of positive variable resistor circuits which insert resistors with resistance values corresponding to the above described gradation signal into a plurality of circuits connecting the positive reference voltage selected by each of the above described positive digital-to-analog conversion circuits with a first positive output terminal or second positive output terminal; and a plurality of negative variable resistor circuits which insert resistors with resistance values corresponding to the above described gradation signal into a plurality of circuits connecting the negative reference voltage selected by each of the above described negative digital-to-analog conversion circuits with a first negative output terminal or second negative output terminal.

Alternatively, the drive circuit may comprise a plurality of positive variable resistor circuits which insert resistors with resistance values corresponding to a digital gradation signal into a plurality of circuits connecting one of a plurality of positive digital-to-analog conversion circuits with a first positive output terminal and into a circuit connecting the other of the above described plurality of positive digital-to-analog conversion circuits with a second positive output terminal, the above described plurality of positive digital-to-analog conversion circuits outputting an analog voltage by converting it into different positive reference voltages according to the above described digital gradation signal; and a plurality of negative variable resistor circuits which insert resistors with resistance values corresponding to a digital gradation signal into a plurality of circuits connecting one of a plurality of negative digital-to-analog conversion circuits with a first negative output terminal and into a circuit connecting the other of the above described plurality of negative digital-to-analog conversion circuits with a second negative output terminal, the above described plurality of negative digital-to-analog conversion circuits outputting an analog voltage by converting it into different negative reference voltages according to the above described digital gradation signal.

At the time of configuring any of the above described drive circuit, the following factors may be added.

(1) In the switching element groups belonging to the above described sampling circuit, a pair of switching elements connected to the same signal line conduct simultaneously in response to the above described signal line selection signal.

(2) In groups of positive switching elements belonging to the above described positive sampling circuit, a pair of switching elements connected to the same signal line conduct simultaneously in response to the above described positive signal line selection signal while in groups of negative switching elements belonging to the above described negative sampling circuit, a pair of switching elements connected to the same signal line conduct simultaneously in response to the above described negative signal line selection signal.

(3) Each of the above described switching elements is constituted of a thin-film transistor.

(4) The above described plurality of reference voltages are fewer in number than the gradations of displayed images.

Also, the present invention is configured as an image display apparatus equipped with any of the above described drive circuit, wherein a plurality of signal lines for transmitting image signals and a plurality of scanning lines for transmitting scanning signals are formed in a matrix-like fashion in an image display area of a substrate, an electro-optical conversion element which changes its light transmittance or emission intensity in response to an electrical signal is placed near each intersection of the signal lines and scanning lines on the above described substrate, the above described signal lines are connected to the drive circuit, and the above described scanning lines are connected to a scanning circuit.

At the time of configuring the above described image display apparatus, the following factors may be added.

(1) Each of the above described switching elements is constituted of a thin-film transistor.

(2) The above described plurality of reference voltages are fewer in number than the gradations of displayed images.

According to the measures described above, by using the junction point between the sampling circuit and each signal line as a voltage dividing point, each reference voltage is divided by the resistance value of the resistor or switching element inserted into the circuit which connects each voltage dividing point and each reference voltage, with each digital-to-analog conversion circuit connected to each voltage dividing point via the sampling circuit or via each variable resistor circuit and the sampling circuit, or with each variable resistor circuit connected to each voltage dividing point via the sampling circuit. Consequently, the resistance value between each voltage dividing point and each signal line can be regarded as zero (0). This makes it possible to increase the resistance values between the reference voltages without increasing the resistance values between the reference voltages and signal lines. This in turn makes it possible to reduce the currents between the reference voltages, contributing to reduced power consumption. Moreover, the power consumption of an image display apparatus with a high resolution or high frame rate can also be reduced because of reduced currents between the reference voltages.

As described above, the present invention can increase the resistance values between the reference voltages without increasing the resistance values between the reference voltages and signal lines. Thus, it can reduce the currents between the reference voltages, contributing to reduced power consumption. Besides, even if it is mounted in an image display apparatus with a high resolution or high frame rate, it can reduce the power consumption of the image display apparatus because of reduced currents between the reference voltages.

BRIEF DESCRIPTION OF THE DRAWINGS

FIGS. 3A and 3B are diagrams illustrating a logical configuration of a control circuit;

FIG. 4 is a diagram illustrating equivalent circuits of an drive circuit;

FIG. 9 is a diagram illustrating equivalent circuits of the drive circuit;

FIG. 15 is a diagram illustrating the relationship between gradation signals inputted into the drive circuit and the voltages generated on signal lines;

FIG. 18 a diagram illustrating the relationship between input voltages and output voltages of D/A conversion elements.

DETAILED DESCRIPTION OF THE EMBODIMENTS

Figure 1:
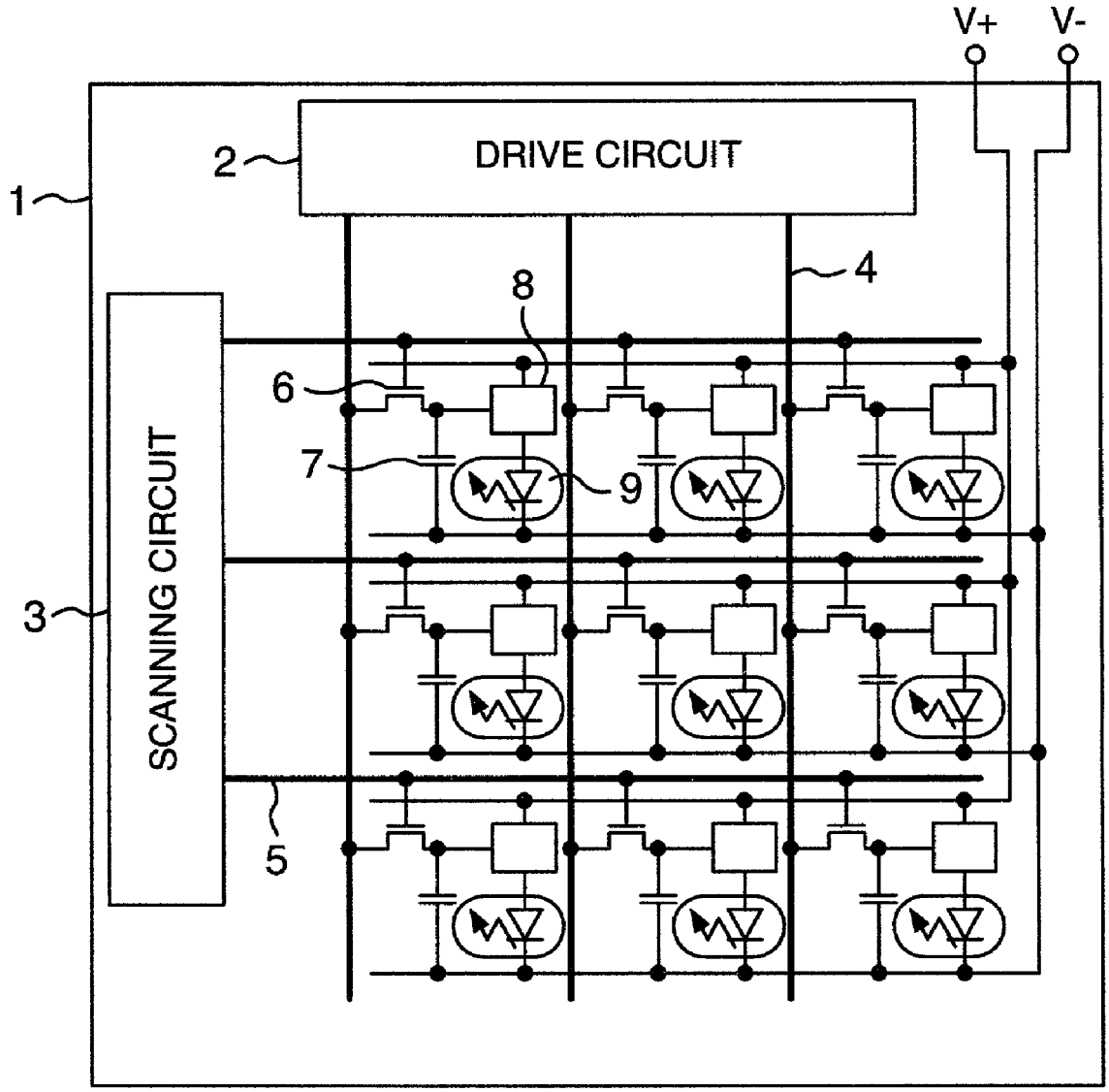
FIG. 1 is a block diagram showing a first embodiment of an image display apparatus according to the present invention.

An embodiment of the present invention will be described below with reference to the drawings. FIG. 1 is a block diagram showing a first embodiment of the image display apparatus according to the present invention. As shown in FIG. 1, the image display apparatus comprises an insulating substrate 1, drive circuit 2, scanning circuit 3, a plurality of signal lines 4, a plurality of scanning wires (scanning lines) 5, etc. The insulating substrate 1 is made, for example, of an insulating material. The plurality of signal lines 4 for transmitting image signals and the plurality of scanning wires (scanning lines) 5 for transmitting scanning pulses (scanning signals) are formed in a matrix-like fashion in an image display area on a surface of the insulating substrate 1. A thin-film transistor 6, capacitive element 7, voltage-to-current conversion circuit 8, and light emitting diode 9 are placed near each intersection of the signal lines 4 and scanning wires 5. The gate electrode of each thin-film transistor 6 is connected to each scanning wire 5. The source electrode or drain electrode is connected to each signal line 4. The remaining electrode—the drain electrode or source electrode—is connected to the capacitive element 7 and voltage-to-current conversion circuit 8. One end of the capacitive element 7 is connected to a positive power supply V+ via the voltage-to-current conversion circuit 8 while the other end of the capacitive element 7 is connected to a negative power supply V−.

Furthermore, the light emitting diode 9, which acts as an electro-optical conversion element, is connected in parallel with the capacitive element 7. Scanning pulses are output from a scanning circuit 3 to the scanning lines 5 in sequence once per frame time (for example, every 1/60 second), the thin-film transistors 6 connected to the scanning lines 5 to which scanning pulses are applied are turned on, and the capacitive elements 7 are charged with the analog voltages supplied to the signal lines 4. At this time, the drive circuit 2 outputs an analog voltage corresponding to the gradation signal for the image to be displayed to each signal line 4 and this analog voltage is held by the capacitive element 7. While the analog voltage is held by the capacitive element 7, the voltage-to-current conversion circuit 8 controls the current to feed to the light emitting diode 9 according to the analog voltage and the light emitting diode 9 glows accordingly. The emission intensity is designed to vary with the current flowing through the light emitting diode 9.

The voltage-to-current conversion circuit 8 can be composed, for example, of a single thin-film transistor. The current between the source electrode and drain electrode can be controlled by a voltage applied to the gate electrode of the thin-film transistor. Each light emitting diode 9 glows as a pixel: all the light emitting diodes 9 in the image display area produces an image on the image display area as they glow together.

Incidentally, according to this embodiment, the drive circuit 2 is placed at one end of the signal lines 4, but it is also possible to divide the drive circuit in half and dispose the split halves of the drive circuit on opposite sides of the insulating substrate 1 with the signal lines 4 placed between them.

Next, the configuration of the drive circuit 2 mounted in the image display apparatus will be described concretely with reference to FIG. 2. The drive circuit 2 of this embodiment, which is a drive circuit for 4-bit gradation (16-gradation) display, comprises D/A conversion circuits 21 and 22 and a sampling circuit 23. Five reference voltages V0 to V4 are set in order to generate analog voltages corresponding to the gradation signals of displayed images based on fewer reference voltages than the number (16) of display gradations. The reference voltages V0 to V4 differ from one another such that "V0>V1>V2>V3>V4" or "V4>V3>V2>V1>V0."

The D/A conversion circuit 21 comprises a control circuit 24 and a plurality of thin-film transistors 26 while the D/A conversion circuit 22 comprises a control circuit 25 and a plurality of thin-film transistors 27. Both thin-film transistors 26 and 27 are divided into groups of three and the thin-film transistors in each group are connected in parallel to one another to serve as switching elements. The drain electrodes or source electrodes of the thin-film transistors 26 in the first group are connected to the reference voltage VO, the gate electrodes are connected to output terminals A, B, and C of the control circuit 24, and the remaining electrodes—the source electrodes or drain electrodes—are connected to a first common output terminal T1 of the thin-film transistors. The drain electrodes or source electrodes of the thin-film transistors 26 in the second group are connected to the reference voltage V2, the gate electrodes are connected to output terminals D, E, and F of the control circuit 24, and the remaining electrodes—the source electrodes or drain electrodes—are connected to the first output terminal T1. Furthermore, the drain electrodes or source electrodes of the thin-film transistors 26 in the third group are connected to the reference voltage V4, the gate electrodes are connected to output terminals G, H, and I of the control circuit 24, and the remaining electrodes—the source electrodes or drain electrodes—are connected to the first output terminal T1.

On the other hand, the drain electrodes or source electrodes of the thin-film transistors 27 in the first group are connected to the reference voltage V1, the gate electrodes are connected to output terminals J, K, and L of the control circuit 25, and the remaining electrodes—the source electrodes or drain electrodes—are connected to a second common output terminal T2 of the thin-film transistors. The drain electrodes or source electrodes of the thin-film transistors 27 in the second group are connected to the reference voltage V3, the gate electrodes are connected to output terminals M, N, and O of the control circuit 25, and the remaining electrodes—the source electrodes or drain electrodes—are connected to the second output terminal T2 of the thin-film transistors. The thin-film transistors 26 or 27 in each group have their conduction resistances set at R1, R2, and R3 to serve as resistors inserted in a circuit which connects the reference voltages V0 to V4 with the output terminal T1 or T2.

The resistance values R1, R2, and R3, which differ from one another, are set as follows:

| | | |
|---|---|---|
| R1 = r − Rsw | . . . | (1) |
| R2 = 2r − Rsw | . . . | (2) |
| R3 = 3r − Rsw | . . . | (3) |
| R3 > R2 > R1 > 0 | . . . | (4) |

where Rsw is the resistance value of the conducting thin-film transistors 29 (in the ON state) composing the sampling circuit 23. The value r may be any resistance value convenient for design, provided that it is set such that all the resistance values R1, R2, and R3 will be positive. The resistance values R1, R2, and R3 of the thin-film transistors 26 and 27 can be implemented by changing the width of each thin-film transistor 26 or 27, or by placing a wiring material (resistance element) in series with the drain electrode or source electrode of each transistor.

To generate 16 analog voltages using five reference voltages V0 to V4, a gradation signal D [3:0] for a 4-bit image is input in the control circuits 24 and 25. The gradation signal D [x:y], in which bit 0 is the LSB, represents binary data between the x-th bit from the LSB and the y-th bit from the LSB. Thus, the gradation signal D [3:0] represents 4-bit binary data from bit 0 to bit 3 ("0000" to "1111"). When a 4-bit gradation signal D [3:0] is input in the control circuits 24 and 25, it can represent one of sixteen gradations and each of the output terminals A to O is set to either "0" or "1" according to the gradation (0 to 15), as shown in FIGS. 3A and 3B. Since the thin-film transistors 26 and 27 are n-channel transistors, they turn on when corresponding output terminals A to O become high (i.e., "1"), and turn off when corresponding output terminals A to O become low (i.e., "0").

Specifically, for the 0th gradation, the thin-film transistor 26 connected to the output terminals A, B, and C turns on; for the 1st gradation, the thin-film transistors 26 and 27 connected to the output terminals C and J turns on; for the 2nd gradation, the thin-film transistors 26 and 27 connected to the output terminals B and K turn on; for the 3rd gradation, the thin-film transistors 26 and 27 connected to the output terminals A and L turns on; for the 4th gradation, the thin-film transistor 27 connected to the output terminals J, K, and L turn on; and so forth. In this way, designated thin-film transistors turn on according to gradation.

In this embodiment, thin-film transistors 26 and 27 are turned on according to the low-order two bits D [1:0] of the gradation signal. As shown in FIGS. 3A and 3B, for the 0th, 4th, 8th, and 12th gradations, the thin-film transistors connected to the output terminals A to C, J to L, D to F, and M to O are turned on. Consequently, the combined resistance (parallel resistance) of the resistance values R1, R2, and R3 is inserted between each of the reference voltages V0, V1, V2, and V3 and the output terminal T1 or T2. Thus, only the reference voltages V0, V1, V2, and V3 are output to the output terminal T1 or T2.

For the 1st, 5th, 9th, and 13th gradations, i.e., if D [1:0]=1, only the thin-film transistors connected to the output terminals C and J, output terminals D and L, output terminals F and M, and output terminals G and O are turned on, a resistor with a resistance value of R1 is inserted between the reference voltage V0, V2, or V4 and the output terminal T1, and a resistor with a resistance value of R3 is inserted between the reference voltage V1 or V3 and the output terminal T2.

Similarly, for the 2nd, 6th, 10th, and 14th gradations, i.e., if D [1:0]=2, a resistor with a resistance value of R2 is inserted between the reference voltage V0, V2, or V4 and the output terminal T1, and a resistor with a resistance value of R2 is inserted between the reference voltage V1 or V3 and the output terminal T2. Furthermore, for the 3rd, 7th, 11th, and 15th gradations, i.e., if D [1:0]=3, a resistor with a resistance value of R3 is inserted between the reference voltage V0, V2, or V4 and the output terminal T1, and a resistor with a resistance value of R1 is inserted between the reference voltage V1 or V3 and the output terminal T2.

On the other hand, the sampling circuit 23 consists of a plurality of n-channel thin-film transistors 29. They are paired and each pair is installed for each of signal lines SL1, SL2, SL3, and SL4. The signal lines SL1 to SL4 correspond to the signal lines 4 of FIG. 1. In practice, however, there are more signal lines. For example, a color image display apparatus with 640-by-480 VGA resolution uses 1920 signal lines (=640×3 colors).

The sampling circuit 23 comprises a control circuit 28 for each pair of the thin-film transistors 29. The output of each control circuit 28 is connected to the gate electrode of each thin-film transistor 29. Besides, the drain electrode or source electrode of one thin-film transistor 29 in each pair is connected to the first output terminal T1 while the remaining electrode—the source or drain electrode—is connected to the signal line SL1, SL2, SL3, or SL4. Also, the drain electrode or source electrode of the other thin-film transistor 29 in each pair is connected to the second output terminal T2 while the remaining electrode—the source or drain electrode—is connected to the signal line SL1, SL2, SL3, or SL4. In other words, the thin-film transistors 29 in each pair have their drain or source electrodes on one side connected to the output terminal T1 or T2 while they have their drain or source electrodes on the other side connected together at a point and further connected to the signal line SL1, SL2, SL3, or SL4 using this junction point as a voltage dividing point.

Figures 5, 6:
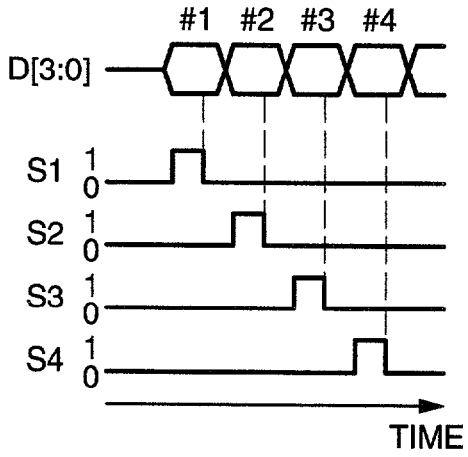
FIG. 5 is a waveform chart illustrating an operation of the control circuit.
FIG. 6 is a diagram illustrating a relationship between gradation signals and the voltages generated on signal lines.

As shown in FIG. 5, logic "1" pulses are input one by one as signal line selection signals into each control circuit 28 of the sampling circuit 23 in sync with D [3:0] gradation signals #1 to #4 and logic "1" pulses are output from the output terminals S1, S2, S3, and S4 of the control circuits 28. The control circuit 28 can be implemented by using, for example, a shift register circuit. When each control circuit 28 outputs a logic "1" pulse in response to a signal line selection signal, the corresponding pair of the thin-film transistors 29 turn on simultaneously and the analog voltage generated at the output terminal T1 or T2 is applied to the corresponding signal line SL1, SL2, SL3, or SL4 using the junction point between the sampling circuit 23 and the signal line SL1, SL2, SL3, or SL4 as a voltage dividing point.

In this case, the voltage applied to the signal lines SL1 to SL4 depend on the low-order two bits D [1:0] of the gradation signal. As shown in FIG. 6, for the 0th, 4th, 8th, or 12th gradation, the combined resistance of the resistance values R1 and R2 is inserted between the reference voltage V0, V2, or V4 and the output terminal T1 as well as between the reference voltage V1, or V3 and the output terminal T2, and thus only one of the reference voltages V0, V1, V2, and V3 is applied to each of the signal lines SL1 to SL4. In other words, only a reference voltage Vn is applied to each of the signal lines SL1 to SL4.

If D [1:0]=1, i.e., for the 1st, 5th, 9th, or 13th gradation, a resistor with a resistance value of R1 or R3 is inserted between the reference voltages and output terminal T1 or T2 as shown in FIG. 4. Thus, the voltage obtained by dividing the reference voltage V0 and reference voltage V1 at an internal ratio of 3:1 is applied to the signal lines SL1 to SL4. Also, if D [1:0]=2, i.e., for the 2nd, 6th, 10th, or 14th gradation, a resistor with a resistance value of R2 is inserted between the reference voltages and output terminal T1 or T2 as shown in FIG. 4. Thus, the voltage obtained by dividing the reference voltage Vn and reference voltage Vn+1 at an internal ratio of 2:2 is applied to the signal lines SL1 to SL4. Specifically, as shown in FIG. 6, a voltage of (V0+V1)/2, (V1+V2)/2, (V2+V3)/2, and (V3+V4)/2 are applied to the signal lines SL1 to SL4 for the 2nd, 6th, 10th, and 14th gradations, respectively.

Similarly, if D [1:0]=3, a resistor with a resistance value of R3 or R1 is inserted between the reference voltages and output terminal T1 or T2 as shown in FIG. 4. Thus, the voltage obtained by dividing the reference voltage Vn and reference voltage Vn+1 at an internal ratio of 1:3 is applied to the signal lines SL1 to SL4. Specifically, as shown in FIG. 6, a voltage of (V0+3V1)/4, (V1+3V2)/4, (V2+3V3)/4, and (V3+3V4)/4 are applied to the signal lines SL1 to SL4 for the 3rd, 7th, 11th, and 15th gradations, respectively.

In this way, according to this embodiment, when gradation signals #1 to #4 which represent the 0th to 15th gradations are input, analog voltages obtained by dividing the reference voltages V0 to V4 into 16 gradation voltages are applied to the signal lines SL1 to SL4 according to gradations. Also, the junction points between the sampling circuit 23 and the signal lines SL1, SL2, SL3, and SL4 are used as voltage dividing points, and only the resistance values R1, R2, and R3 of the thin-film transistors 26 and 27 and the resistance values Rsw of the conducting thin-film transistors 29 are inserted between the voltage dividing points and reference voltages. Consequently, the resistance value between the voltage dividing points and reference voltages can be considered to be zero. This means that the resistance between reference voltages can be increased, thereby reducing the currents between the reference voltages, without increasing the resistance between the reference voltages and signal lines. Therefore, even if the drive circuit 2 is mounted in an image display apparatus with a high resolution or high frame rate, it can reduce the power consumption.

Incidentally, although the embodiment described above handles 4-bit gradation, it is also possible to display 6-bit, 8-bit, or higher gradations by increasing the number of parallel thin-film transistors 26 and 27 in the D/A conversion circuits 21 and 22 or the number of gradations in the D/A conversion elements.

Figures 7, 8A, 8B, 8C:
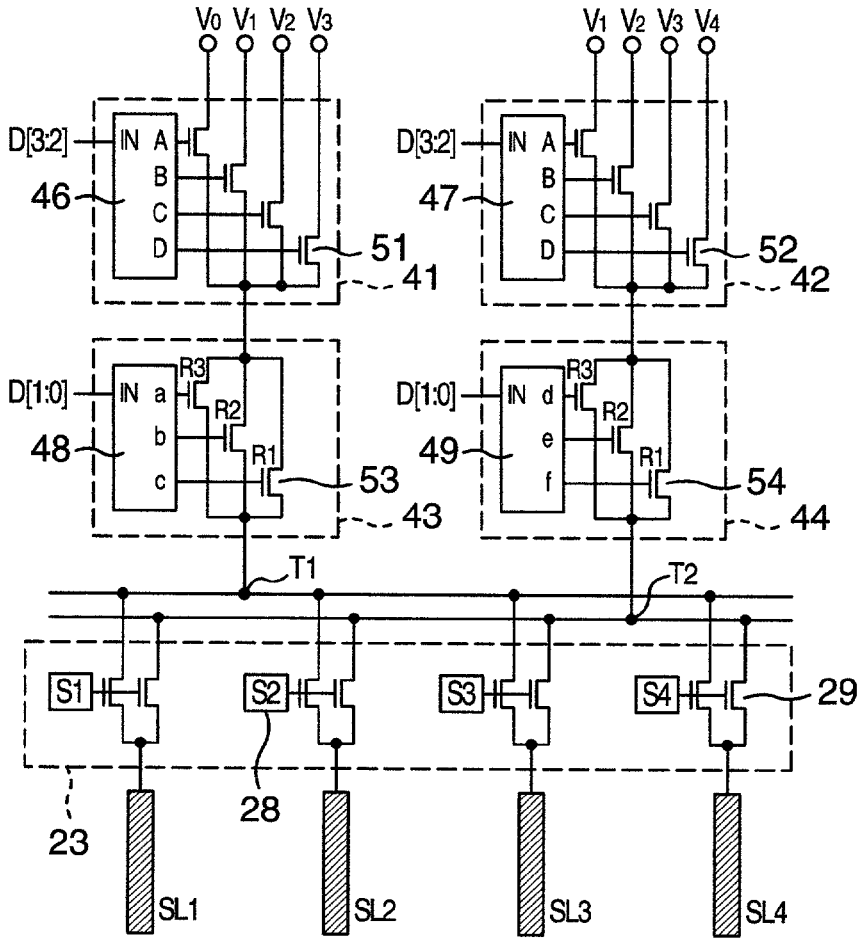
FIG. 7 is a block circuit diagram showing a second embodiment of the drive circuit according to the present invention.
FIGS. 8A, 8B and 8C are diagrams illustrating the logical configuration of a control circuit.

Next, a second embodiment of the drive circuit 2 will be described with reference to FIG. 7. The-drive circuit 2 of this embodiment consists of D/A conversion circuits 41 and 42 and variable resistor circuits 43 and 44 instead of the D/A conversion circuits 21 and 22 shown in FIG. 2, and it comprises the same sampling circuit 23 as that shown in FIG. 2.

The D/A conversion circuits 41 and 42, which work as digital-to-analog conversion circuits for selecting one of different reference voltages V0 to V4 according to a digital gradation signal, consist of control circuits 46 and 47 and four n-channel thin-film transistors 51 and 52, respectively. The gate electrodes of the thin-film transistors 51 are connected to respective output terminals A, B, C, and D of the control circuit 46. The drain or source electrodes are connected to the reference voltages V0, V1, V2, and V3 while the remaining electrodes—the source or drain electrodes—are connected together at a junction point, which in turn is connected to a variable resistor circuit 43. On the other hand, the gate electrodes of the thin-film transistors 52 are connected to respective output terminals A, B, C, and D of the control circuit 47. The drain or source electrodes are connected to the reference voltages V1, V2, V3, and V4 while the remaining electrodes—the source or drain electrodes—are connected together at a common junction point which in turn is connected to a variable resistor circuit 44. The reference voltages V0 to V4 differ from one another such that "V0>V1>V2>V3>V4" or "V4>V3>V2>V1>V0." The resistance value of the thin-film transistors 51 and 52 during conduction (in the ON state) is set at RDA.

To allow reference voltages to be selected according to gradations, the high-order two bits D [3:2] of the gradation signal for a 4-bit image are input in the control circuits 46 and 47. If data "00" for the high-order two bits is input in input terminals IN of the control circuits 46 and 47 as a gradation signal D [1:0]=0 for the 0th, 4th, 8th, or 12th gradation, a logic "1" signal is output from the output terminal A as shown in FIG. 8A, turning on only the thin-film transistors 51 and 52 connected to the output terminal A, and the reference voltages V0 and V1 are output to variable resistor circuits 43 and 44, respectively. If data "01" for the high-order two bits is input as a gradation signal D [1:0]=1, only the output terminal B goes to logical "1, " turning on only the thin-film transistors 51 and 52 connected to the output terminal B, and the reference voltages V1 and V2 are output to the variable resistor circuits 43 and 44, respectively. If data "10" for the high-order two bits is input as a gradation signal D [1:0]=2, only the output terminal C goes to logical "1, " turning on only the thin-film transistors 51 and 52 connected to the output terminal C, and the reference voltages V2 and V3 are output to the variable resistor circuits 43 and 44, respectively. Also, if data "11" for the high-order two bits is input as a gradation signal D [1:0]=3, only the output terminal D goes to logical "1, " turning on only the thin-film transistors 51 and 52 connected to the output terminal D, and the reference voltages V3 and V4 are output to the variable resistor circuits 43 and 44, respectively.

On the other hand, the variable resistor circuits 43 and 44 consist of control circuits 48 and 49 and three n-channel thin-film transistors 53 and 54, respectively. The variable resistor circuits 43 and 44 are connected on the output side to a first output terminal T1 and second output terminal T2, respectively. The thin-film transistors 53 are connected in parallel to one another. Their gate electrodes are connected to output terminals a, b, and c of the control circuit 48, respectively. The drain or source electrodes are connected together to the D/A conversion circuit 41 while the remaining electrodes—the source or drain electrodes—are connected together to the output terminal T1. Similarly, the thin-film transistors 54 are connected in parallel to one another. Their gate electrodes are connected to output terminals d, e, and f of the control circuit 49, respectively. The drain or source electrodes are connected together to the D/A conversion circuit 42 while the remaining electrodes—the source or drain electrodes—are connected together to the output terminal T2.

To allow resistance values to be selected according to gradations, the low-order two bits D [1:0] of the gradation signal for a 4-bit image are input in the control circuits 48 and 49. As shown in FIG. 8B, the control circuit 48 outputs a logic "1" signal to the output terminals a, b, and c when D [1:0]=0, outputs a logic "1" signal only to the output terminal c when D [1:0]=1, outputs a logic "1" signal only to the output terminal b when D [1:0]=2, and outputs a logic "1" signal only to the output terminal a when D [1:0]=3. When a logic "1" signal is input to the gate electrodes, the thin-film transistors 53 connected to the output terminals a, b, and c turn on and function as resistors inserted in a circuit which connects the D/A conversion circuit 41 and output terminal T1. The resistors have resistance values determined by the resistance values of the conducting thin-film transistors 53. The thin-film transistors 53 connected to the output terminals a, b, and c have resistance values R3, R2, and R1, respectively, when conducting.

The resistance values R1, R2, and R3 are given as:

| | | |
|---|---|---|
| $R1 = r - R_{DA} - Rsw$ | . . . | (5) |
| $R2 = 2r - R_{DA} - Rsw$ | . . . | (6) |
| $R3 = 3r - R_{DA} - Rsw$ | . . . | (7) |
| $R3 > R2 > R1 > 0$ | . . . | (8) |

where $R_{DA}$ is the resistance value of the conducting thin-film transistors 51 and 52 while Rsw is the resistance value of the conducting thin-film transistors 29 of the sampling circuit 23.

The three thin-film transistors 54 composing the variable resistor circuit 44 are connected in parallel to one another. Their gate electrodes are connected to the output terminals d, e, and f of the control circuit 49, respectively. The drain or source electrodes are connected together to the D/A conversion circuit 42 while the remaining electrodes—the source or drain electrodes—are connected together to the output terminal T2. To allow resistance values to be selected according to gradations, the low-order two bits D [1:0] of the gradation signal for a 4-bit image are input in the control circuit 49. If a two bit gradation signal D [1:0]=0 is input in an input terminal IN of the control circuit 49, all the output terminals d, e, and f go to logical "0, " as shown in FIG. 8C. If D [1:0]=1 is input, only the output terminal d outputs a logic "1" signal. If D [1:0]=2 is input, only the output terminal e outputs a logic "1" signal. If D [1:0]=3 is input, only the output terminal f outputs a logic "1" signal. The thin-film transistors 54 turn on only when the output terminals d, e, and f go to logical "1. " The thin-film transistors 54 connected to output terminals d, e, and f have resistance values R3, R2, and R1, respectively, when conducting. The resistance values R1to R3 have the relations given by equations (5) to (8).

If a gradation signal D [1:0]=0 for the 0th, 4th, 8th, or 12th gradation is input in the control circuits 46 to 49, all the thin-film transistors 53 in the variable resistor circuit 43 turn on and function as resistors inserted between the reference voltage V0 and output terminal T1, yielding the combined resistance of the thin-film transistors 53. Specifically, the combined resistance (parallel resistance) of the resistance values R1, R2, and R3 is inserted between the reference voltage V0 and output terminal T1 as shown in FIG. 9.

Then if a gradation signal for the 1st, 5th, 9th, or 13th gradation is input in the control circuits 46 to 49, only the thin-film transistors 53 and 54 connected to the output terminals c and d turn on and function as resistors with the resistance value R1 inserted between the reference voltage V1 and output terminal T1 and resistors with the resistance value R3 inserted between the reference voltage V2 and output terminal T2, as shown in FIG. 9.

Similarly, if a gradation signal D [1:0]=2 for the 2nd, 6th, 10th, or 14th gradation is input in the control circuits 46 to 49, a resistor with a resistance value of R2 is inserted between the reference voltage V2 and output terminal T1 and a resistor with a resistance value of R2 is inserted between the reference voltage V3 and the output terminal T2, as shown in FIG. 9. Furthermore, if a gradation signal D [1:0]=3 for the 3rd, 7th, 11th, or 15th gradation is input in the control circuits 46 to 49, a resistor with a resistance value of R3 is inserted between the reference voltage V3 and output terminal T1 and a resistor with a resistance value of R1is inserted between the reference voltage V4 and the output terminal T2, as shown in FIG. 9.

As logic "1" signals are input one by one into the control circuits 28 of the sampling circuit 23 as signal line selection signals in sync with gradation signals #1 to #4 for the 0th to 15th gradations, gradation voltages obtained by dividing the reference voltages V0 to V4 into 16 levels are applied in sequence to the signal lines SL1 to SL4, as analog voltages which represent image signals.

This embodiment applies analog voltages in sequence to the signal lines SL1 to SL4 according to gradations using the junction points between the sampling circuit 23 and the signal lines SL1 to SL4 as voltage dividing points.

In this way, according to this embodiment, when gradation signals #1 to #4 which represent the 0th to 15th gradations are input, analog voltages obtained by dividing the reference voltages V0 to V4 into 16 gradation voltages are applied to the signal lines SL1 to SL4 according to gradations. Also, the junction points between the sampling circuit 23 and the signal lines SL1, SL2, SL3, and SL4 are used as voltage dividing points, and only the resistance values R1, R2, and R3 of the thin-film transistors 53 and 54, the resistance values Rsw of the conducting thin-film transistors 29, and the resistance values $R_{DA}$ of the conducting thin-film transistors 51 and 52 are inserted between the voltage dividing points and reference voltages. Consequently, the resistance value between the voltage dividing points and each signal line can be considered to be zero. This means that the resistance between reference voltages can be increased, thereby reducing the currents between the reference voltages, without increasing the resistance between the reference voltages and signal lines. Therefore, even if the drive circuit 2 is mounted in an image display apparatus with a high resolution or high frame rate, it can reduce the power consumption of the image display apparatus.

Next, a third embodiment of the drive circuit 2 will be described with reference to FIG. 10. The drive circuit 2 of this embodiment consists of the variable resistor circuits 43 and 44 and sampling circuit 23 shown in FIG. 7. Also, an equivalent of a digital-to-analog conversion circuit is mounted external to the drive circuit 2. It consists of D/A conversion elements 61 and 62 and amplifier elements 63 and 64. The D/A conversion element 61 is connected to the variable resistor circuit 43 via the amplifier element 63 while the D/A conversion element 62 is connected to the variable resistor circuit 44 via the amplifier element 64. The D/A conversion elements 61 and 62 are configured as digital-to-analog conversion circuits for converting analog voltages according to a digital gradation signal and outputting the resulting reference voltages different from one another. The high-order two bits D [3:2] of the gradation signal for a 4-bit image are input in input terminals IN of the D/A conversion elements 61 and 62.

Figures 10, 11:
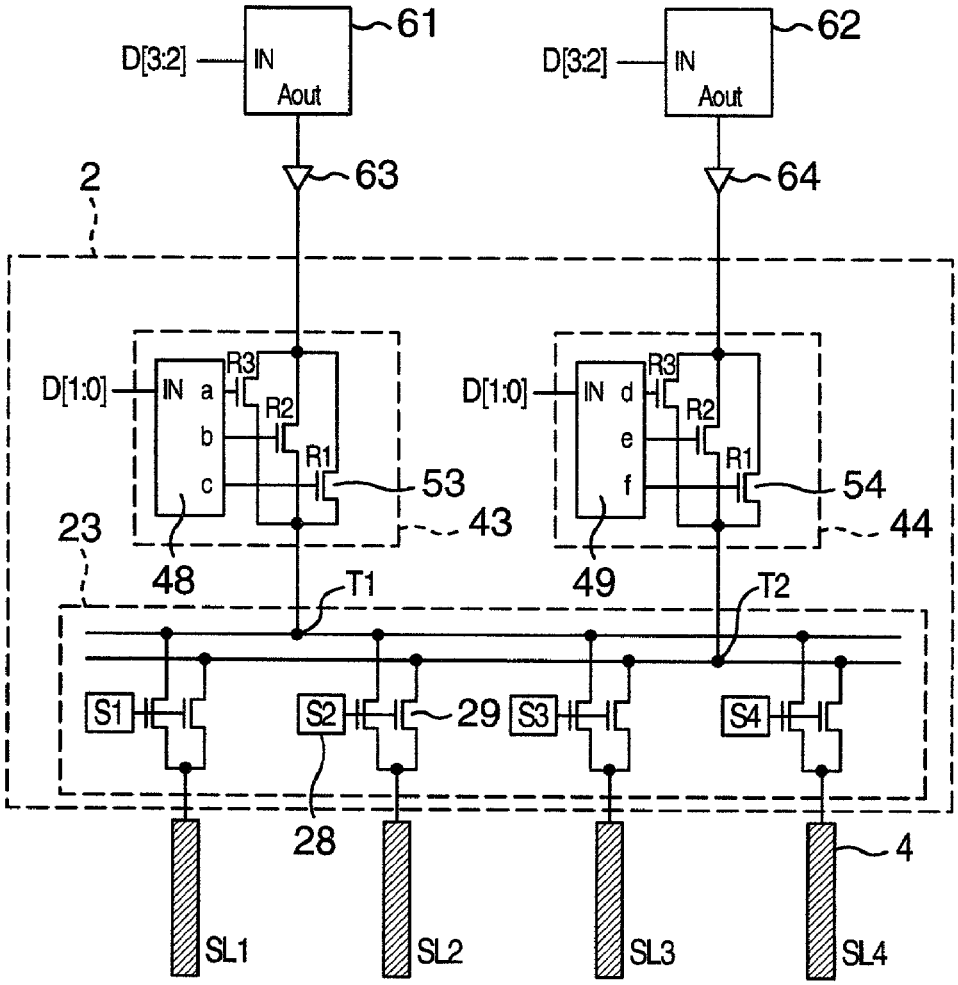
FIG. 10 is a block circuit diagram showing a third embodiment of the drive circuit according to the present invention.
FIG. 11 a diagram illustrating a relationship between input voltages and output voltages of D/A conversion elements.

As shown in FIG. 11, the D/A conversion elements 61 and 62 output the reference voltages V0 and V1 from output terminals Aout when D [3:2]=0, output the reference voltages V1 and V2 when D [3:2]=1, output the reference voltages V2 and V3 when D [3:2]=2, and output the reference voltages V3 and V4 when D [3:2]=3. The reference voltages V0 to V4 are set at the same values as with the embodiments described above. The reference voltages output from the D/A conversion elements 61 and 62 are amplified by the amplifier elements 63 and 64, respectively, and are input in the variable resistor circuits 43 and 44. The amplifier elements 63 and 64 are provided to lower the output resistance values of the D/A conversion elements 61 and 62, and may be omitted if the output resistance values of the D/A conversion elements 61 and 62 are sufficiently low. Also, they may be omitted if the D/A conversion elements 61 and 62 have amplifier functions.

While the reference voltages V0 to V4 are being input from the D/A conversion elements 61 and 62 into the drive circuit 2, as gradation signals #1 to #4 for the 0th to 15th gradations are input in the control circuits 48 and 49 and signal line selection signals in sync with the gradation signals are input one by one into the control circuits 28, analog voltages according to gradations are applied as image signals to the signal lines SL1 to SL4 using the junction points between the sampling circuit 23 and the signal lines SL1 to SL4 as voltage dividing points.

In this way, according to this embodiment, when gradation signals #1 to #4 which represent the 0th to 15th gradations are input, analog voltages obtained by dividing the reference voltages V0 to V4 into 16 gradation voltages are applied to the signal lines SL1 to SL4 according to gradations. Also, the junction points between the sampling circuit 23 and the signal lines SL1 to SL4 are used as voltage dividing points, and only the resistance values R1, R2, and R3 of the thin-film transistors 53 and 54 and the resistance values Rsw of the conducting thin-film transistors 29 are inserted between the voltage dividing points and reference voltages. Consequently, the resistance value between the voltage dividing points and each signal line can be considered to be zero. This means that the resistance between reference voltages can be increased, thereby reducing the currents between the reference voltages, without increasing the resistance between the reference voltages and signal lines. Therefore, even if the drive circuit 2 is mounted in an image display apparatus with a high resolution or high frame rate, it can reduce the power consumption of the image display apparatus.

With the drive circuit 2 of the above embodiments, when the gradation signal=0, no current flows between the reference voltage Vn and reference voltage Vn+1 and only one of the reference voltages is applied to signal lines, and thus the power consumption due to the current between reference voltages can be reduced to zero. On the other hand, when the gradation signal=1 to 3, although current flows between the reference voltage Vn and reference voltage Vn+1, since it flows through a circuit which connects one of the reference voltages with the other reference voltage via the voltage dividing point, the resistance (r3) between the voltage dividing points and signal lines SL1 to SL4 is negligible. Therefore, power consumption can be reduced without increasing the output resistance value of the drive circuit 2.

Figure 12:
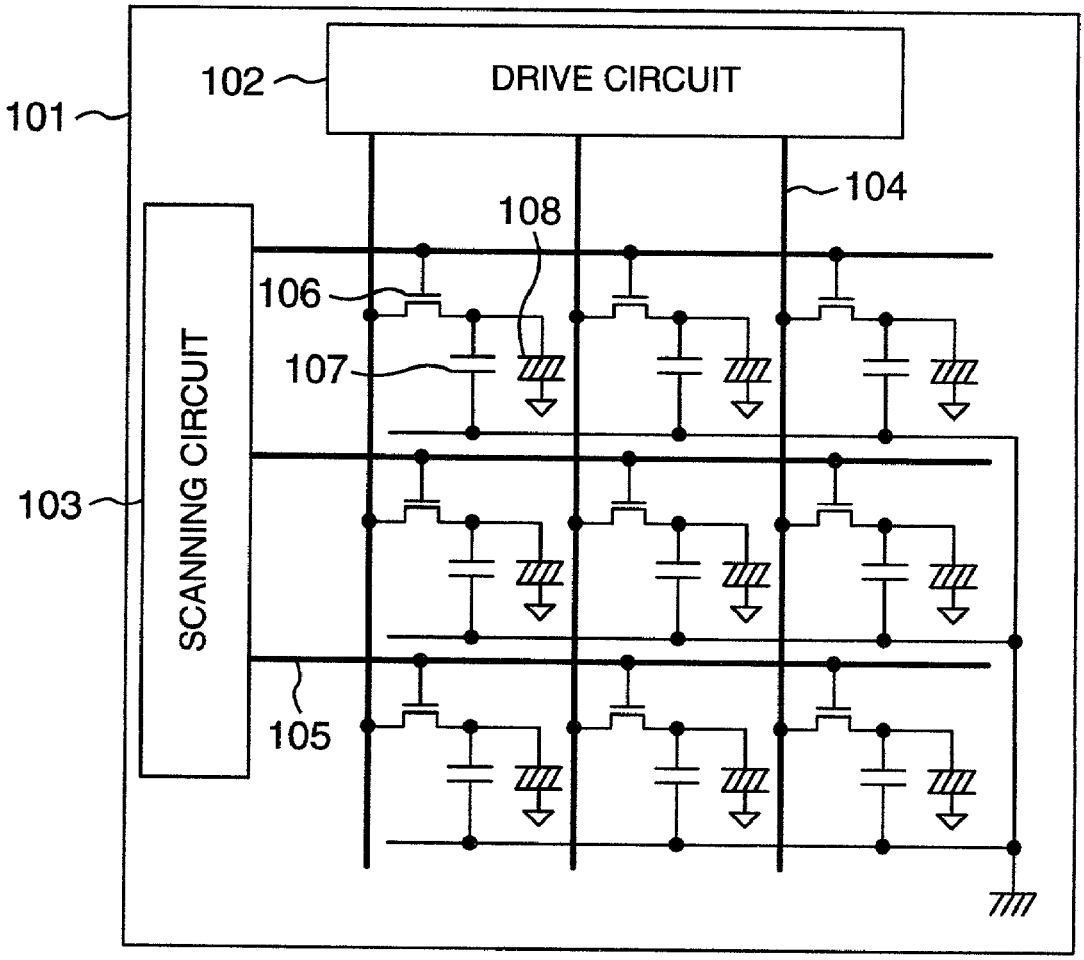
FIG. 12 is a block diagram showing a second embodiment of the image display apparatus according to the present invention.

Next, a second embodiment of the image display apparatus according to the present invention will be described with reference to FIG. 12. The image display apparatus of this embodiment, which uses liquid crystals as an electro-optical conversion element, consists of an insulating substrate 101, drive circuit 102, scanning circuit 103, etc. The insulating substrate 101 is made of transparent glass. A plurality of signal lines 104 for transmitting image signals and a plurality of scanning wires (scanning lines) 105 for transmitting scanning pulses are formed in a matrix-like fashion in an image display area of the insulating substrate 101. A thin-film transistor 106, capacitive element 107, and display electrode 108 are placed near each intersection of the signal lines and scanning wires 105. The drive circuit 102 and scanning circuit 103 are mounted outside the image display area. The gate electrode of each thin-film transistor 106 is connected to each scanning wire 105. The source electrode or drain electrode is connected to each signal line 104. The remaining electrode—the drain electrode or source electrode—is connected to the capacitive element 107 and display electrode 108. The capacitive element 107 is connected in parallel to the transparent display electrode 108 and one of its ends is grounded alternately. The display electrode 108 has a transparent electrode formed on its surface and is connected through liquid crystals to an insulating substrate opposite the insulating substrate 101. In other words, the liquid crystals are sandwiched between the insulating substrate 101 and the other insulating substrate, and the transparent electrode on the insulating substrate opposite the insulating substrate 101 is grounded alternately.

When scanning pulses are applied to the scanning lines 105 once per frame, the thin-film transistors 106 connected to the scanning lines 105 are turned on in sequence, and the capacitive elements 107 are charged with the analog voltages on the signal lines 104 via the thin-film transistors 106. The charged analog voltages are held by the capacitive elements 107 and display electrodes 108. While the analog voltages are held by the capacitive elements 107 and display electrodes 108, the liquid crystals between the display electrodes 108 and transparent electrodes have their polarization changed by the amplitudes of analog voltages which change polarity every frame, i.e., the amplitudes of AC voltages applied to the signal lines 104. A deflection plate is provided outside each of the two opposing substrates to output light with changing transmittance so that images produced by changes in the transmittance of the liquid crystals will be displayed in the image display area. Incidentally, although the drive circuit 102 described above is placed at one end of the signal lines 104, it is also possible to divide the drive circuit 2 in half and dispose the split halves of the drive circuit on opposite sides of the insulating substrate 101 with the signal lines 104 placed between them.

Figure 13:
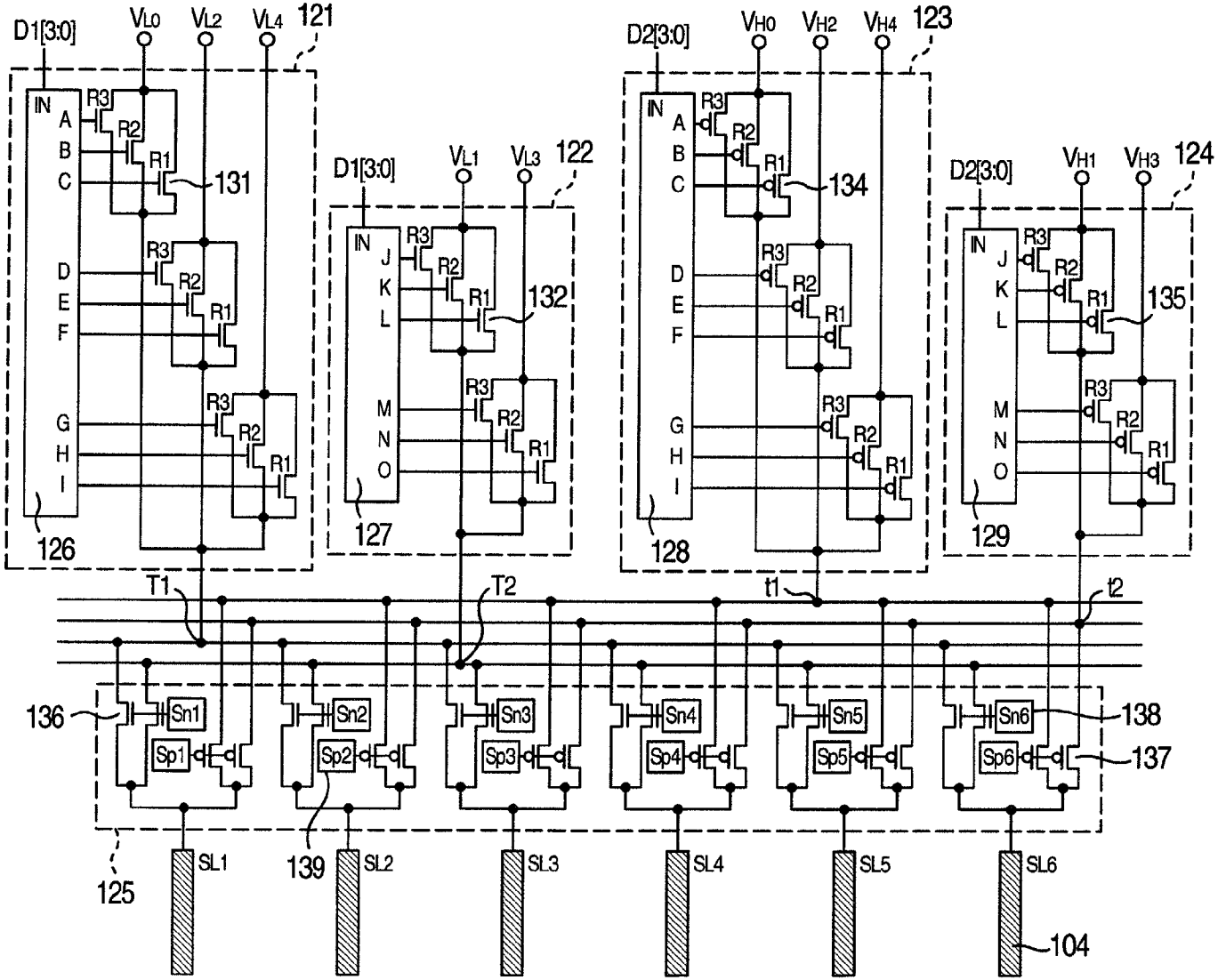
FIG. 13 is a block circuit diagram showing a fourth embodiment of the drive circuit according to the present invention.

Next, an embodiment of the drive circuit 102 that can apply AC voltages between all display electrodes 108 and transparent electrodes will be described with reference to FIG. 13. The drive circuit 102 of this embodiment consists of D/A conversion circuits 121, 122, 123, and 124 and a sampling circuit 125, to work as a drive circuit for 4-bit gradation display. The sampling circuit 125 is connected to six signal lines SL1 to SL6 which correspond to the signal lines 104.

The D/A conversion circuits 121 and 122, which work as negative (low-tension side) digital-to-analog conversion circuits, consist of control circuits 126 and 127 and a plurality of n-channel thin-film transistors 131 and 132, respectively.

Figure 2:
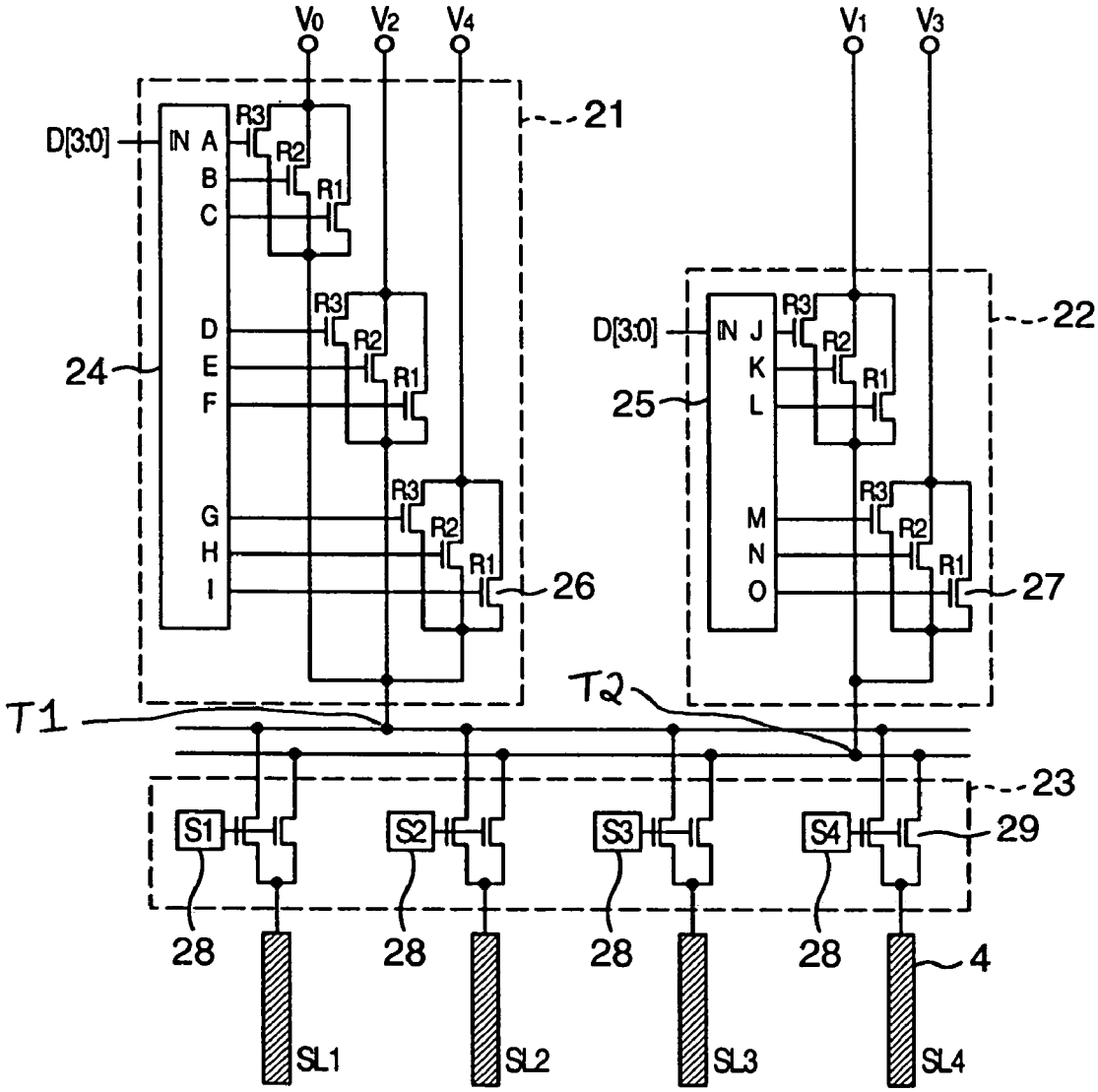
FIG. 2 is a block circuit diagram showing a first embodiment of a drive circuit according to the present invention.

They have the same functions as the D/A conversion circuits 21 and 22 shown in FIG. 2 except that negative (low-tension side) reference voltages VL0, VL2, VL4, VL1, and VL3 are input. Specifically, a gradation signal D1 [3:0] for a 4-bit image is input in each of the control circuits 126 and 127. Both n-channel thin-film transistors 131 and 132 are divided into groups of three and the thin-film transistors in each group are connected in parallel to one another. The thin-film transistors 131 and 132 connected to output terminals A, D, G, J, and M have their conduction resistance set at R3, the thin-film transistors 131 and 132 connected to output terminals B, E, H, K, and N have their conduction resistance set at R2, and the thin-film transistors 131 and 132 connected to output terminals C, F, I, L, and O have their conduction resistance set at R1. The groups of thin-film transistors 131 or 132 are connected together on the output side. The output side of the D/A conversion circuit 121 is connected to the sampling circuit 125 via a first negative (low-tension side) output terminal T1 while the output side of the D/A conversion circuit 122 is connected to the sampling circuit 125 via a second negative (low-tension side) output terminal T2.

On the other hand, D/A conversion circuits 123 and 124, which work as positive (high-tension side) digital-to-analog conversion circuits, consist of control circuits 128 and 129 and a plurality of p-channel thin-film transistors 134 and 135, respectively. The D/A conversion circuits 123 and 124 have the same functions as the D/A conversion circuits 121 and 122 except that they output analog voltages obtained by dividing positive (high-tension side) reference voltages as a reference voltage according to the gradation. Specifically, the D/A conversion circuit 123 is set at different positive (high-tension side) reference voltages VH0, VH2, and VH4 while the D/A conversion circuit 124 is set at positive (high-tension side) reference voltages VH1 and VH3. The reference voltages differ from one another such that "VH0>VH1>VH2>VH3>VH4>VL4>VL3>VL2>VL1>VL0."

A gradation signal D2 [3:0] for a 4-bit image is input in the control circuits 128 and 129. Both thin-film transistors 134 and 135 are divided into groups of three and the thin-film transistors in each group are connected in parallel to one another. Each group is connected on one end to one of the reference voltages VH0 to VH4 and connected together on the other end to a first positive (high-tension side) output terminal t1 or second positive (high-tension side) output terminal t2. The thin-film transistors 134 and 135 connected to output terminals A, D, G, J, and M have their conduction resistance set at R3, the thin-film transistors 134 and 135 connected to output terminals B, E, H, K, and N have their conduction resistance set at R2, and the thin-film transistors 134 and 135 connected to output terminals C, F, I, L, and O have their conduction resistance set at R1. The relationship among the resistance values R1 to R3 are the same as that for the embodiments described above.

Figure 14A:
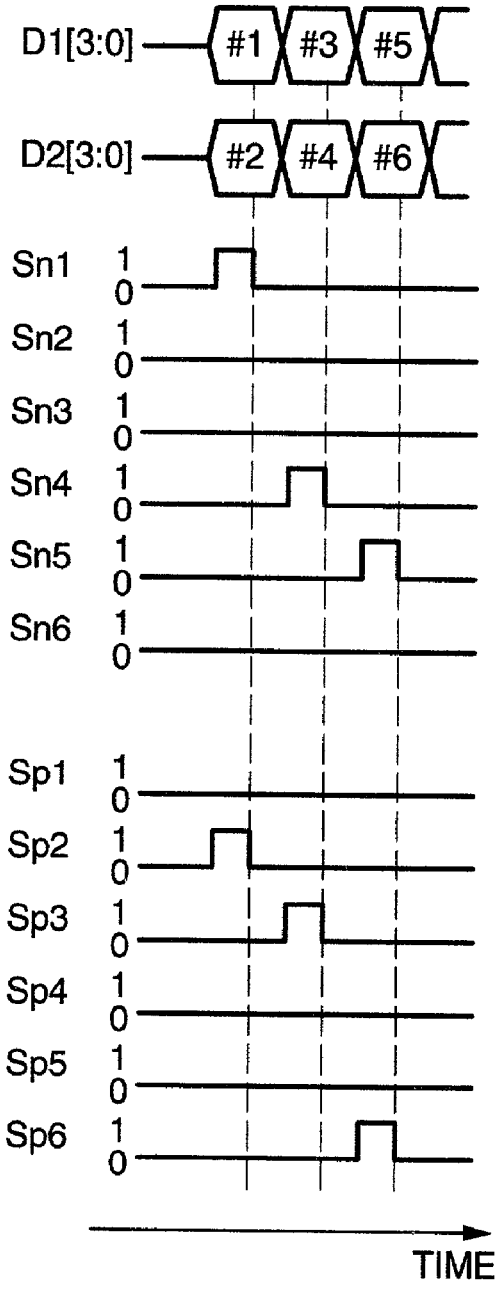
FIGS. 14A and 14B are time charts illustrating the operation of the drive circuit in frame periods.
Figure 14B:
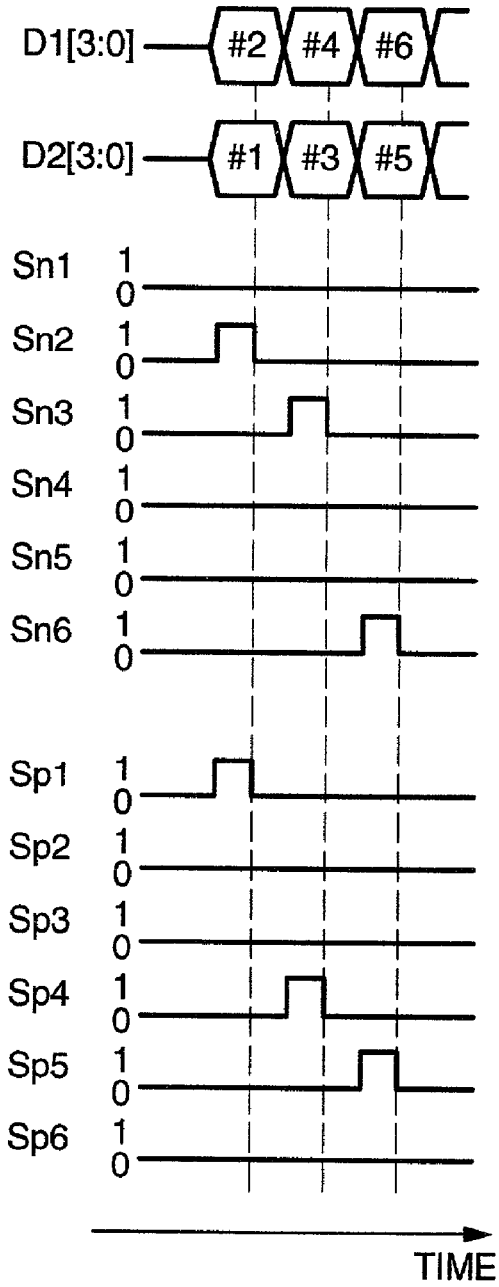

Suppose the gradation signal D1 [3:0] shown in FIG. 14A and the gradation signal D1 [3:0] shown in FIG. 14B enter alternately into the control circuit 128 every other frame period while the gradation signal D2 [3:0] shown in FIG. 14A and the gradation signal D2 [3:0] shown in FIG. 14B enter alternately into the control circuit 129 every other frame period. During the frame period shown in FIG. 14A, reference voltages VL0 to VL4 or voltages obtained by dividing the reference voltages are output to the output terminals T1 and T2 in response to gradation signals #1, #3, and #5 while reference voltages VH0 to VH4 or voltages obtained by dividing the reference voltages are output to the output terminals t1 and t2 in response to gradation signals #2, #4, and #6. Conversely, during the frame period shown in FIG. 14B, positive reference voltages or voltages obtained by dividing the positive reference voltages are output to the output terminals t1 and t2 in response to gradation signals #2, #4, and #6 while negative reference voltages or voltages obtained by dividing the negative reference voltages are output to the output terminals T1 and T2 in response to gradation signals #1, #3, and #5. When a logic "1" signal is output from the control circuits 128 and 129, p-channel thin-film transistors 134 and 135 start to conduct in response to the logic "1" signal because the logic "1" signal has a lower voltage than "0" voltage.

The sampling circuit 125 consists of a plurality of n-channel thin-film transistors 136 and a plurality of p-channel thin-film transistors 137 serving as switching elements as well as a plurality of control circuits 138 and 139 for controlling the on/off operation of the thin-film transistors. The sampling circuit 125 is connected on the output side to signal lines SL1 to SL6 which correspond to the signal lines 104, using the junction points between the sampling circuit 125 and the signal lines SL1 to SL6 as voltage dividing points. The thin-film transistors 136 and control circuits 138 are configured as a negative (low-tension side) sampling circuit. The n-channel thin-film transistors 136 are paired and the thin-film transistors 136 in each pair are connected in parallel. Their gate electrodes are connected to the respective control circuits 138. The source electrodes or drain electrodes are connected to the output terminal T1 or T2. The remaining electrodes—the drain or source electrodes—are connected together to respective signal lines SL1 to SL6 via junction points which serve as voltage dividing points. The p-channel thin-film transistors 137 and control circuits 139 are configured as a positive (high-tension side) sampling circuit. The thin-film transistors 137 are paired and the thin-film transistors 137 in each pair are connected in parallel. The gate electrodes of the thin-film transistors 137 in each pair are connected to each control circuit 139. The source electrodes or drain electrodes are connected to the output terminal t1 or t2. The remaining electrodes—the drain or source electrodes—are connected together to respective signal lines SL1 to SL6 via junction points which serve as voltage dividing points. The thin-film transistors 136 and 137 have their conduction resistance set at Rsw.

Pulses are input as negative (low-tension side) signal line selection signals into each control circuit 138 in sync with gradation signals #1 to #6. In response to the pulses, a logic "1" signal is output from the output terminals Sn1 to Sn6 of the control circuits 138 to turn on the thin-film transistors 136 in each pair simultaneously. Also, pulses are input as positive (high-tension side) signal line selection signals into each control circuit 139 in sync with gradation signals #1 to #6 and a logic "1" signal is output from the output terminals Sp1 to Sp6 of the control circuits 139. In this case, since the thin-film transistors 137 connected to the control circuits 139 are p-channel transistors, the logic "1" signal has a lower voltage than "0" voltage, and thus the logic "1" signal turns on the thin-film transistors 137 simultaneously.

Figure 16:
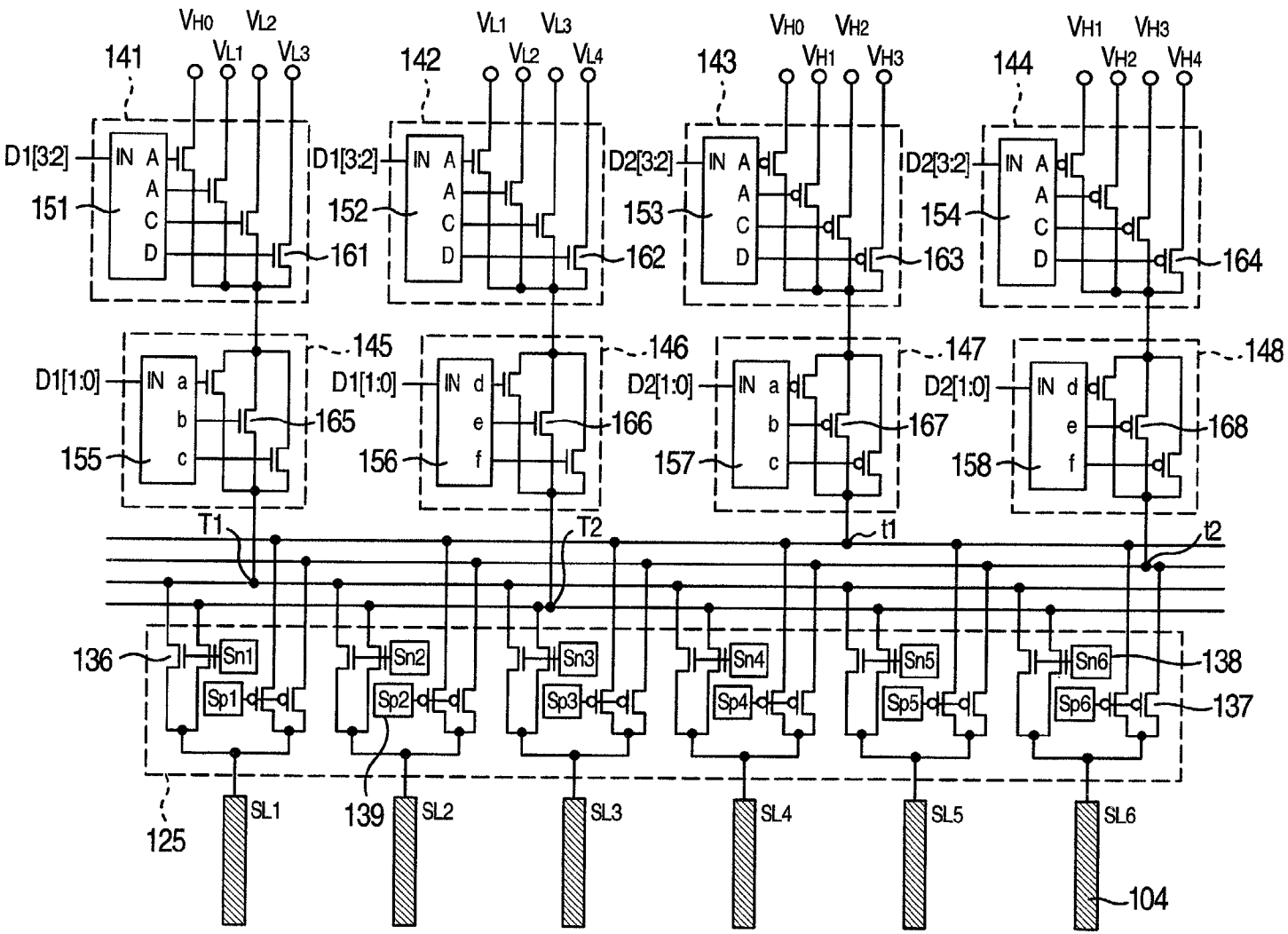
FIG. 16 is a block circuit diagram showing a fifth embodiment of the drive circuit according to the present invention.

If in the above configuration, D1 [3:0] and D2 [3:0] gradation signals #1 to #6 are generated during a certain frame period and logic "1" signals are output in sequence from the output terminals Sn1, Sn3, Sn5, Sp2, Sp4, and Sp6 as shown in FIG. 14A, 16 levels of low analog voltage are generated on odd-numbered signal lines SL1, SL3, and SL5 as shown in FIG. 15(*b*) and 16 levels of high analog voltage are generated on even-numbered signal lines SL2, SL4, and SL6 as shown in FIG. 15(*a*).

As the gradation signals shown in FIG. 14B are input during the next frame period and logic "1" signals are output from the output terminals Sn2, Sn4, Sn6, Sp1, Sp3, and SpS, 16 levels of high voltage are generated on odd-numbered signal lines SL1, SL3, and SL5 corresponding to gradations as shown in FIG. 15(*a*) while 16 levels of low voltage are generated on even-numbered signal lines SL2, SL4, and SL6 corresponding to gradations as shown in FIG. 15(*b*).

Through repetition of the operations shown in FIGS. 14A and 14B every other frame, AC analog voltage which has 16 amplitude levels corresponding to gradations—with the maximum amplitude reached when the value of the gradation signal is 0 and the minimum amplitude reached when the value of the gradation signal is 15—is applied to the signal lines, thereby driving the liquid crystals.

Since this embodiment applies reference voltages or voltages obtained by dividing the reference voltages to the signal lines SL1 to SL6, by using the junction points between the signal lines SL1 to SL6 and the sampling circuit 125 as voltage dividing points, it can increase the resistance between the reference voltages and thus reduce the currents between the reference voltages without increasing the resistance between the reference voltages and signal lines. Consequently, it can reduce the power consumption of the image display apparatus (liquid crystal display) even if the image display apparatus has a high resolution or high frame rate.

Incidentally, although the embodiment described above uses six signal lines SL1 to SL6, there are-more signal lines in practice. For example, a color image display apparatus with 640-by-480 VGA resolution uses 1920 signal lines (=640×3 colors). Besides, although the embodiment described above handles 4-bit gradation, it is also possible to display 6-bit, 8-bit, or higher gradations by increasing the number of parallel thin-film transistors in the D/A conversion circuits 121 to 124 or the number of gradations in the D/A conversion elements.

Next, a second embodiment of the drive circuit 102 will be described with reference to FIG. 16. The drive circuit 102 of this embodiment comprises D/A conversion circuits 141, 142, 143, and 144 and variable resistor circuits 145, 146, 147, and 148 instead of the D/A conversion circuits 121, 122, 123, and 124 of the above described embodiment. However, it comprises the same sampling circuit 125 as the above embodiment. The D/A conversion circuits 141 and 142, which work as negative (low-tension side) digital-to-analog conversion circuits, consist of control circuits 151 and 152 and a plurality of n-channel thin-film transistors 161 and 162. They have the same functions as the D/A conversion circuits 41 and 42 shown in FIG. 7 except that reference voltages are different. A gradation signal D1 [3:2] of a 4-bit image is input in the control circuits 151 and 152. Negative (low-tension side) reference voltages VL0, VL1, VL2, and VL3 are applied to the thin-film transistors 161 while negative (low-tension side) reference voltages VL1, VL2, VL3, and VL4 are applied to the thin-film transistors 162. The thin-film transistors 161 are connected together on the output side to the variable resistor circuit 145 while the thin-film transistors 162 are connected together on the output side to the variable resistor circuit 146. The variable resistor circuits 145 and 146, which work as negative (low-tension side) variable resistor circuits, consist of control circuits 155 and 156 and a plurality of n-channel thin-film transistors 165 and 166. They have the same functions as the variable resistor circuits 53 and 54 shown in FIG. 7 except that negative (low-tension side) reference voltages are applied to the variable resistor circuits 145 and 146. A gradation signal D1 [1:0] of a 4-bit image signal is input in the control circuits 155 and 156. The thin-film transistors 165 and 166 connected to output terminals a and d have their conduction resistance set at R3, the thin-film transistors 165 and 166 connected to output terminals b and e have their conduction resistance set at R2, and the thin-film transistors 165 and 166 connected to output terminals c and f have their conduction resistance set at R1. The thin-film transistors 165 and thin-film transistors 166 are connected to respective common points and the variable resistor circuits 145 and 146 are connected on the output side to output terminals T1 and T2, respectively.

On the other hand, the D/A conversion circuits 143 and 144, which work as positive (high-tension side) digital-to-analog conversion circuits, consist of control circuits 153 and 154 and a plurality of p-channel thin-film transistors 163 and 164. They have the same functions as the D/A conversion circuits 141 and 142 except that reference voltages and the channel type of the transistors are different. A gradation signal D2 [3:2] for a 4-bit image is input in the control circuits 153 and 154. The thin-film transistors 163 are connected to reference voltages VH0, VH1, VH2, and VH3 while the thin-film transistors 164 are connected to reference voltages VH1, VH2, VH3, and VH4. On the output side, the thin-film transistors 163 and 164 are connected together to variable resistor circuits 147 and 148, respectively.

The variable resistor circuits 147 and 148, which work as positive (high-tension side) variable resistor circuits, consist of control circuits 157 and 158 and a plurality of p-channel thin-film transistors 167 and 168. They have the same functions as the variable resistor circuits 145 and 146 except that applied reference voltage levels are different. A gradation signal D2 [1:0] for a 4-bit image is input in the control circuits 157 and 158. The thin-film transistors 167 are connected in parallel to one another and the junction point is connected to the output terminal t1 while the thin-film transistors 168 are connected in parallel to one another and the junction point is connected to the output terminal t2. The thin-film transistors 167 and 168 connected to the output terminals a and d of the control circuits 157 and 158 have their conduction resistance set at R3, the thin-film transistors 167 and 168 connected to the output terminals b and e have their conduction resistance set at R2, and the thin-film transistors 167 and 168 connected to the output terminals c and f have their conduction resistance set at R1.

If in the above configuration, D1 [3:0] and D2 [3:0] gradation signals #1 to #6 are generated during a certain frame period and logic "1" signals are output in sequence from the output terminals Sn1, Sn3, Sn5, Sp2, Sp4, and Sp6 as shown in FIG. 14A, 16 levels of low analog voltage are generated on odd-numbered signal lines SL1, SL3, and SL5 as shown in FIG. 15(*b*) and 16 levels of high analog voltage are generated on even-numbered signal lines SL2, SL4, and SL6 as-shown in FIG. 15(*a*).

As the gradation signals shown in FIG. 14B are input during the next frame period and logic "1" signals are output from the output terminals Sn2, Sn4, Sn6, Sp1, Sp3, and Sp5, 16 levels of high voltage are generated on odd-numbered signal lines SL1, SL3, and SL5 corresponding to gradations as shown in FIG. 15(*a*) while 16 levels of low voltage are generated on even-numbered signal lines SL2, SL4, and SL6 corresponding to gradations as shown in FIG. 15(*b*).

Through repetition of the operations shown in FIGS. 14A and 14B every other frame, AC analog voltage which has 16 amplitude levels corresponding to gradations—with the maximum amplitude reached when the value of the gradation signal is 0 and the minimum amplitude reached when the value of the gradation signal is 15—is applied to the signal lines, thereby driving the liquid crystals.

Since this embodiment applies reference voltages or voltages obtained by dividing the reference voltages to the signal lines SL1 to SL6, by using the junction points between the signal lines SL1 to SL6 and the sampling circuit 125 as voltage dividing points, it can increase the resistance between the reference voltages and thus reduce the currents between the reference voltages without increasing the resistance between the reference voltages and signal lines. Consequently, it can reduce the power consumption of the image display apparatus (liquid crystal display) even if the image display apparatus has a high resolution or high frame rate.

Figure 17:
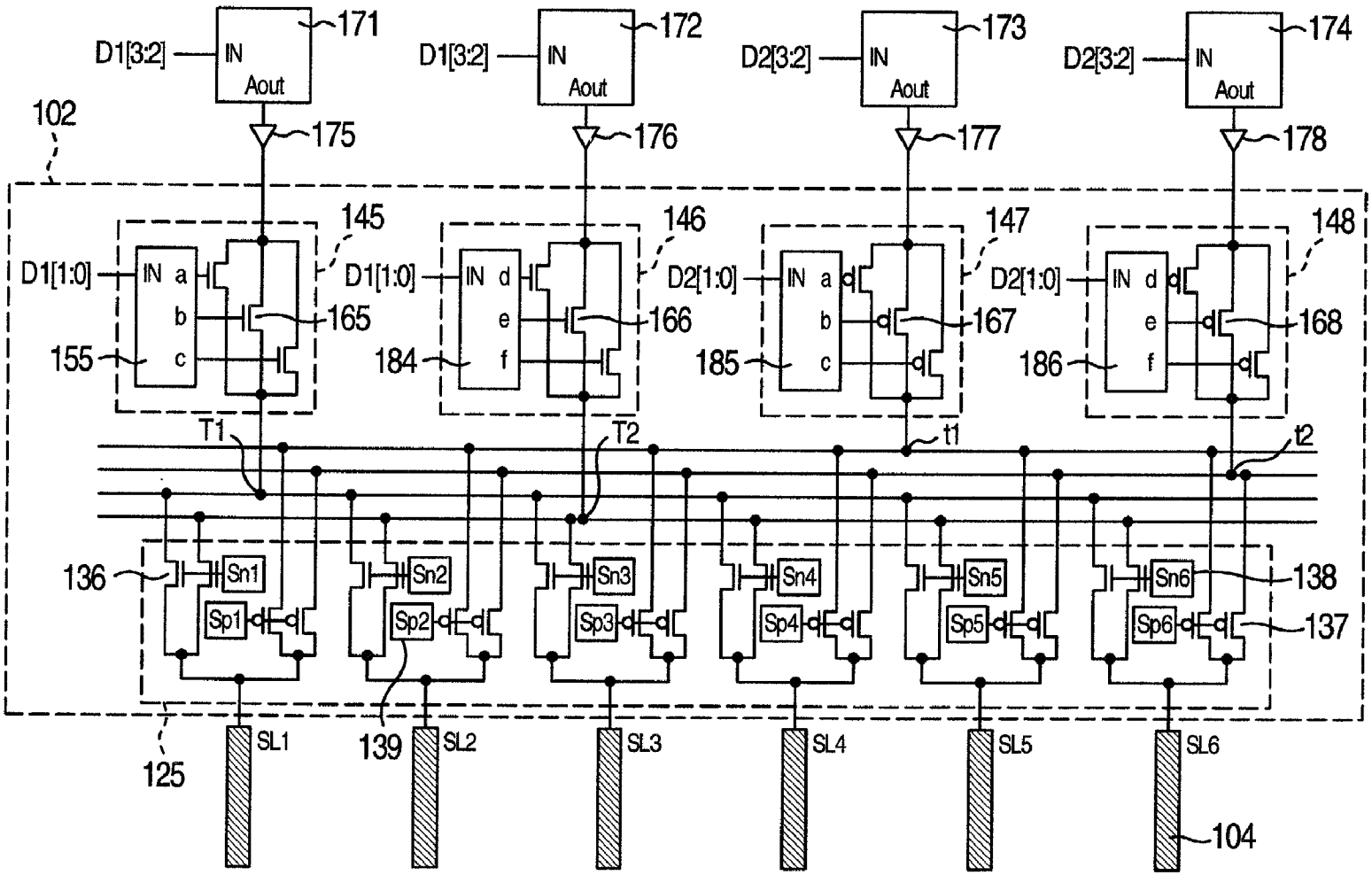
FIG. 17 is a block circuit diagram showing a sixth embodiment of the drive circuit according to the present invention.

Next, a third embodiment of the drive circuit 102 will be described with reference to FIG. 17. The drive circuit 102 of this embodiment consists of variable resistor circuits 145, 146, 147 and 148 as well as a sampling circuit 125. Externally, it also has D/A conversion elements 171 to 174 which correspond to the D/A conversion circuits 141, 142, 143, and 144 as well as amplifier elements 175 to 178. The rest of the configuration is the same as that shown in FIG. 16.

The D/A conversion elements 171 and 172 and the amplifier elements 175 and 176, which work as negative (low-tension side) digital-to-analog conversion circuits, have the same functions as the D/A conversion elements 61 and 62 and amplifier elements 63 and 64 shown in FIG. 10. The gradation signal D1 [3:2] for a 4-bit image is input in input terminals IN of the D/A conversion elements 171 and 172. In response to the high-order two bits D1 [3:2] of the gradation signal for a 4-bit image, the D/A conversion elements 171 and 172 output the negative (low-tension side) reference voltages VL0, VL1, VL2, VL3, and VL4 according to gradations from output terminals Aout to the variable resistor circuits 145 and 146 via the amplifier elements 175 and 176, respectively, as shown in FIG. 18.

On the other hand, the D/A conversion elements 173 and 174 and the amplifier elements 177 and 178, which work as positive (high-tension side) digital-to-analog conversion circuits, have the same functions as the D/A conversion elements 61 and 62 and amplifier elements 63 and 64 shown in FIG. 10. When the high-order two bits D2 [3:2] of the gradation signal for a 4-bit image is input in input terminals IN of the D/A conversion elements 173 and 174, the positive (high-tension side) reference voltages VH0, VH1, VH2, VH3, and VH4 are output according to gradations from output terminals Aout to the variable resistor circuits 147 and 148.

If in the above configuration, D1 [3:0] and D2 [3:0] gradation signals #1 to #6 are generated during a certain frame period and logic "1" signals are output in sequence from the output terminals Sn1, Sn3, Sn5, Sp2, Sp4, and Sp6 as shown in FIG. 14A, 16 levels of low analog voltage are generated on odd-numbered signal lines SL1, SL3, and SL5 as shown in FIG. 15(*b*) and 16 levels of high analog voltage are generated on even-numbered signal lines SL2, SL4, and SL6 as shown in FIG. 15(*a*).

As the gradation signals shown in FIG. 14B are input during the next frame period and logic "1" signals are output from the output terminals Sn2, Sn4, Sn6, Sp1, Sp3, and Sp5, 16 levels of high voltage are generated on odd-numbered signal lines SL1, SL3, and SL5 corresponding to gradations as shown in FIG. 15(*a*) while 16 levels of low voltage are generated on even-numbered signal lines SL2, SL4, and SL6 corresponding to gradations as shown in FIG. 15(*b*).

Through repetition of the operations shown in FIGS. 14A and 14B every other frame, AC voltage which has 16 amplitude levels corresponding to gradations—with the maximum amplitude reached when the value of the gradation signal is 0 and the minimum amplitude reached when the value of the gradation signal is 15—is applied to the signal lines, thereby driving the liquid crystals.

Since this embodiment applies reference voltages or voltages obtained by dividing the reference voltages to the signal lines SL1 to SL6, by using the junction points between the signal lines SL1 to SL6 and the sampling circuit 125 as voltage dividing points, it can increase the resistance between the reference voltages and thus reduce the currents between the reference voltages without increasing the resistance between the reference voltages and signal lines. Consequently, it can reduce the power consumption of the image display apparatus (liquid crystal display) even if the image display apparatus has a high resolution or high frame rate.

What is claimed is:

1. A drive circuit, comprising:

a plurality of digital-to-analog conversion circuits each of which selects one of difference reference voltages according to a digital gradation signal; and a sampling circuit which selectively connects each output terminal of two of the digital-to-analog conversion circuits to signal lines, wherein each of the digital-to-analog conversion circuits includes a variable resistor circuit with a resistance value corresponding to a digital gradation; and wherein the sampling circuit comprises a plurality of pairs of switches, and a pair of switches is simultaneously activated and have an approximate same resistance value when the pair of switches is activated; and wherein a divided voltage for outputting to a signal line is generated by a first series resistance and a second series resistance, the first resistance comprises a variable resistance circuit included in one of the digital-to-analog conversion circuits and one of the pair of switches, the one of the digital-to-analog conversion circuits is connected to the sampling circuit and the second series resistance comprises a variable resistor circuit included in another of the digital-to-analog conversion circuits and another of the pair of switches.

2. The drive circuit according to claim 1, wherein said difference reference voltages are fewer in number than the gradations of displayed images.

3. An image display apparatus equipped with the drive circuit according to claim 1, wherein a plurality of signal lines for transmitting image signals and a plurality of scanning lines for transmitting scanning signals are formed in a matrix-like fashion in an image display area of a substrate, an electro-optical conversion element which changes its light transmittance or emission intensity in response to an electrical signal is placed near each intersection of the signal lines and scanning lines on said substrate, said signal lines are connected to said drive circuit, and said scanning lines are connected to a scanning circuit.

4. A drive circuit, comprising:

a plurality of digital-to-analog conversion circuits each of which selects one of difference reference voltages corresponding to a digital gradation signal;

a plurality of variable resistor circuits with a resistance value corresponding to a digital gradation signal; and a sampling circuit which selectively connects each output terminal of two of the variable resistor circuits to one of a plurality of signal lines, wherein each output terminal of the digital-to-analog conversion circuits connects to a corresponding variable resistor circuit;

wherein the sampling circuit comprises a plurality of pairs of switches, and a pair of switches is simultaneously activated and have an approximate same resistance value when the pair of switches is activated; and wherein a divided voltage for outputting to a signal line is generated by a first series resistance and a second series resistance, the first series resistance comprises one of the variable resistance circuits and one of the pair of switches, the one of the variable resistance circuits is connected to the sampling circuit and the second series resistance comprises another of variable resistor circuits and another of the pair of switches.

5. The drive circuit according to claim 4, wherein said plurality of variable resistor circuits include switching elements which conduct according to said gradation signal as the resistors with resistance values corresponding to said gradation signal.

6. The drive circuit according to claim 4, wherein said plurality of variable resistor circuits include switching elements which conduct according to said gradation signal and resistance elements, connected in series with each other, as the resistors with resistance values corresponding to said gradation signal.

7. The drive circuit according to claim 4, wherein said difference reference voltages are fewer in number than the gradations of displayed images.

8. An image display apparatus equipped with the drive circuit according to claim 4, wherein a plurality of signal lines for transmitting image signals and a plurality of scanning lines for transmitting scanning signals are formed in a matrix-like fashion in an image display area of a substrate, an electro-optical conversion element which changes its light transmittance or emission intensity in response to an electrical signal is placed near each intersection of the signal lines and scanning lines on said substrate, said signal lines are connected to said drive circuit, and said scanning lines are connected to a scanning circuit.

9. A drive circuit, comprising:

a plurality of digital-to-analog conversion circuits each of which outputs an analog signal corresponding to a digital gradation signal;

a plurality of variable resistor circuits with a resistance value corresponding to a digital gradation signal; and a sampling circuit which selectively connects each output terminal of two of a plurality of variable resistor circuits to a corresponding one of signal lines, wherein each output terminal of the digital-to-analog conversion circuit connects to a corresponding variable resistor circuit, wherein the sampling circuit comprises a plurality of pairs of switches, and a pair of switches is simultaneously activated and have an approximate same resistance value when the pair of switches are activated; and wherein a divided voltage for outputting to a signal line is generated by a first series resistance and a second series resistance, the first resistance comprises one of variable resistance circuits and one of the switches, the one of variable resistance circuits is connected to the sampling circuit and the second series resistance comprises another of variable resistor circuits and another of the pair of switches.

10. The drive circuit according to claim 9, wherein said plurality of variable resistor circuits include switching elements which conduct according to said gradation signal as the resistors with resistance values corresponding to said gradation signal.

11. An image display apparatus equipped with the drive circuit according to claim 9, wherein a plurality of signal lines for transmitting image signals and a plurality of scanning lines for transmitting scanning signals are formed in a matrix-like fashion in an image display area of a substrate, an electro-optical conversion element which changes its light transmittance or emission intensity in response to an electrical signal is placed near each intersection of the signal lines and scanning lines on said substrate, said signal lines are connected to said drive circuit, and said scanning lines are connected to a scanning circuit.

12. The drive circuit according to claim 9, wherein said plurality of variable resistor circuits include switching elements which conduct according to said gradation signal and resistance elements, connected in series with each other, as the resistors with resistance values corresponding to said gradation signal.

13. The drive circuit according to claim 12, wherein said switching elements comprise thin-film transistors.

14. The drive circuit according to claim 9, wherein said switching elements comprise thin-film transistors.

15. The drive circuit according to claim 9, wherein said difference reference voltages are fewer in number than the gradations of displayed images.

16. A drive circuit, comprising:

a plurality of first digital-to-analog conversion circuits each of which selects one of difference positive reference voltages corresponding to a digital gradation signal;

a plurality of second digital-to-analog conversion circuits each of which selects one of difference negative reference voltages corresponding to a digital gradation signal; and a sampling circuit which selectively connects each output terminal of two of the first digital-to-analog conversion circuits to signal lines, wherein each of the first digital-to-analog conversion circuits includes a variable resistor circuit with a resistance value corresponding to a digital gradation signal;

wherein each of the second digital-to-analog conversion circuits includes a variable resistor circuit with a resistance value corresponding to another digital gradation signal;

wherein the sampling circuit comprises a plurality of pairs of switches, a pair of switches is simultaneously activated and has an approximate same resistance value when the pair of switches is activated; and wherein a divided voltage for outputting a signal line is generated by a first series resistor and a second series resistor, the first resistor comprises a variable resistor circuit included in one of the first digital-to-analog conversion circuits and one of the pairs of switches, the one of the first digital-to-analog conversion circuits is connected to the sampling circuit and the second series resistor comprises a variable resistor circuit included in another of the first digital-to-analog conversion circuits and another of the pairs of switches;

wherein another divided voltage for outputting to another signal line is generated by a third series resistor and a fourth series resistor, the third series resistor comprises a variable resistor circuit included in one of the second digital-to-analog conversion circuit and one of the pair of switches, the one of the second digital-to-analog conversion is connected to the sampling circuit and the fourth series resistor comprises a variable resistor circuit included in one of the second digital-to-analog conversion circuit, the one of the second digital-to-analog conversion circuits is connected to the sampling circuit and the fourth series resistor comprises a variable resistor circuit included in another of the second digital-to-analog conversion circuits and another of the pairs of switches.

17. The drive circuit according to claim 16, wherein said difference reference voltages are fewer in number than the gradations of displayed images.

18. An image display apparatus equipped with the drive circuit according to claim 16, wherein a plurality of signal lines for transmitting image signals and a plurality of scanning lines for transmitting scanning signals are formed in a matrix-like fashion in an image display area of a substrate, liquid crystals which change their light transmittance in response to an electrical signal are placed near each intersection of the signal lines and scanning lines on said substrate, said liquid crystals are sandwiched between said substrate and another substrate, said signal lines are connected to said drive circuit, and said scanning lines are connected to a scanning circuit.

19. The image display apparatus according to claim 18, wherein said switching elements comprise thin-film transistors.

20. The image display apparatus according to claim 18, wherein said reference voltages are fewer in number than the gradations of displayed images.

21. A drive circuit, comprising:

a plurality of first digital-to-analog conversion circuits each of which selects one of difference positive reference voltage corresponding to a digital gradation signal;

a plurality of second digital-to-analog conversion circuits each of which selects one of difference negative reference voltage corresponding to a digital gradation signal;

a plurality of first variable resistor circuits with a resistance value corresponding to a digital gradation signal;

a plurality of second variable resistor circuits with a resistance value corresponding to another digital gradation signal; and a sampling circuit which selectively connects each output terminal of two of the first variable resistor circuits and each terminal of two of the second variable resistor circuits to signal lines, wherein each output terminal of the first digital-to-analog conversion circuits connects to a corresponding first variable resistor circuit;

wherein each output terminal of the second digital-to-analog conversion circuits connects to a corresponding second variable resistor circuit, wherein the sampling circuit comprises a plurality of pairs of switches, a pair of switches is simultaneously activated and has an approximate same resistance value when the pair of switches is activated;

wherein a divided voltage for outputting to a signal line is generated by a first series resistor and a second series resistor, the first series resistor comprises one of the first variable resistor circuits and one of the pairs of switches, the one of the first variable resistor circuit is connected to the sampling circuit and the second series resistor circuit comprises another of the first variable resistor circuits and another of the pairs of switches; and wherein another divided voltage for outputting to another signal line is generated by a third series resistor and a fourth series resistor, the third series resistor comprises one of the second variable resistor circuits and one of the pairs of switches, the one of the second variable resistor is connected to the sampling circuit and the fourth series resistor comprises another of the second variable resistor circuits and another of pairs of switches.

22. The drive circuit according to claim 21, wherein said plurality of positive variable resistor circuits and said plurality of negative variable resistor circuits include switching elements which conduct according to said gradation signal as the resistors with resistance values corresponding to said gradation signal.

23. The drive circuit according to claim 21, wherein said plurality of positive variable resistor circuits and said plurality of negative variable resistor circuits include switching elements which conduct according to said gradation signal and resistance elements, connected in series with each other, as the resistors with resistance values corresponding to said gradation signal.

24. The drive circuit according to claim 21, wherein said difference reference voltages are fewer in number than the gradations of displayed images.

25. An image display apparatus equipped with the drive circuit according to claim 21, wherein a plurality of signal lines for transmitting image signals and a plurality of scanning lines for transmitting scanning signals are formed in a matrix-like fashion in an image display area of a substrate, liquid crystals which change their light transmittance in response to an electrical signal are placed near each intersection of the signal lines and scanning lines on said substrate, said liquid crystals are sandwiched between said substrate and another substrate, said signal lines are connected to said drive circuit, and said scanning lines are connected to a scanning circuit.

26. The image display apparatus according to claim 25, wherein said switching elements comprise thin-film transistors.

27. The image display apparatus according to claim 25, wherein said reference voltages are fewer in number than the gradations of displayed images.

28. A drive circuit, comprising:

a plurality of first digital-to-analog conversion circuits each of which outputs a positive analog voltage corresponding to a digital gradation signal;

a plurality of second digital-to-analog conversion circuits each of which outputs a negative analog voltage corresponding to a digital gradation signal;

a plurality of first variable resistor circuits with a resistance value corresponding to a digital gradation signal;

a plurality of second variable resistor circuits with a resistance value corresponding to another digital gradation signal; and a sampling circuit which selectively connects each output terminal of two of the first variable resistor circuits and each terminal of two of the second variable resistor circuits to signal lines, wherein each output terminal of the first digital-to-analog conversion circuits connects to a corresponding first variable resistor circuit, wherein each output terminal of the second digital-to-analog conversion circuits connects to a corresponding second variable resistor circuit, wherein the sampling circuit comprises a plurality of pairs of switches, a pair of switches is simultaneously activated and has an approximate same resistance value when the pair of switches is activated;

wherein a divided voltage for outputting to a signal line is generated by a first series resistor and a second series resistor, the first series resistor comprises one of the first variable resistor circuits and one of the pairs of switches, the one of the first variable resistor circuit is connected to the sampling circuit and the second series resistor circuit comprises another of the first variable resistor circuits and another of the pairs of switches; and wherein another divided voltage for outputting to another signal line is generated by a third series resistor and a fourth series resistor, the third series resistor comprises one of the second variable resistor circuits and one of the pairs of switches, the one of the second variable resistor is connected to the sampling circuit and the fourth series resistor comprises another of the second variable resistor circuits and another of pairs of switches.

29. The drive circuit according to claim 28, wherein said plurality of positive variable resistor circuits and said plurality of negative variable resistor circuits include switching elements which conduct according to said gradation signal as the resistors with resistance values corresponding to said gradation signal.

30. The drive circuit according to claim 28, wherein said difference reference voltages are fewer in number than the gradations of displayed images.

31. The drive circuit according to claim 28, wherein said plurality of positive variable resistor circuits and said plurality of negative variable resistor circuits include switching elements which conduct according to said gradation signal and resistance elements, connected in series with each other, as the resistors with resistance values corresponding to said gradation signal.

32. An image display apparatus equipped with the drive circuit according to claim 28, wherein a plurality of signal lines for transmitting image signals and a plurality of scanning lines for transmitting scanning signals are formed in a matrix-like fashion in an image display area of a substrate, liquid crystals which change their light transmittance in response to an electrical signal are placed near each intersection of the signal lines and scanning lines on said substrate, said liquid crystals are sandwiched between said substrate and another substrate, said signal lines are connected to said drive circuit, and said scanning lines are connected to a scanning circuit.

33. The image display apparatus according to claim 32, wherein said switching elements comprise thin-film transistors.

34. The image display apparatus according to claim 32, wherein said reference voltages are fewer in number than the gradations of displayed images.

* * * * *